US006330944B1

(12) United States Patent
DeMichele

(10) Patent No.: US 6,330,944 B1
(45) **Date of Patent: *Dec. 18, 2001**

(54) MULTI-FUNCTION GOLF BAG

(76) Inventor: Christopher J. De Michele, 380 Wilson Ave., Township of Washington, NJ (US) 07675

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/947,036

(22) Filed: Oct. 8, 1997

(51) Int. Cl.[7] ..... A63B 55/00

(52) U.S. Cl. ..... 206/315.3; 206/315.4; 206/315.5; 206/315.6; 206/315.7; 206/8; 206/278; 206/278.1

(58) Field of Search ..... 206/315.3, 315.4, 206/315.5, 315.6, 315.7, 8, 278, 278.1; 190/18 A

(56) References Cited

U.S. PATENT DOCUMENTS

| | | | | |
|---|---|---|---|---|
| 3,150,881 | | 9/1964 | Van Skyock . | |
| 3,559,709 | | 2/1971 | Siebold . | |
| 3,729,038 | | 4/1973 | Ekeson . | |
| 4,142,563 | | 3/1979 | Ackerfeldt et al. . | |
| 4,350,194 | | 9/1982 | Brown . | |
| 4,506,769 | | 3/1985 | Franco et al. . | |
| 4,522,299 | | 6/1985 | Clark et al. . | |
| 4,657,135 | | 4/1987 | Kjose . | |
| 4,796,789 | | 1/1989 | Willcocks . | |
| 4,822,071 | | 4/1989 | Widegren . | |
| 4,890,856 | | 1/1990 | Mursch et al. . | |
| 4,905,827 | | 3/1990 | Kim . | |
| 4,911,292 | | 3/1990 | Airey, Jr. . | |
| 4,949,844 | | 8/1990 | Yang . | |
| 4,961,497 | * | 10/1990 | Sherer et al. | 206/315.4 |
| 5,071,147 | | 12/1991 | Stansbury . | |
| 5,267,750 | | 12/1993 | Thompson . | |
| 5,358,109 | | 10/1994 | Nichols . | |
| 5,415,285 | | 5/1995 | Reimers . | |
| 5,454,576 | | 10/1995 | Pitkanen . | |
| 5,458,240 | | 10/1995 | Rich et al. . | |
| 5,470,095 | | 11/1995 | Bridges . | |
| 5,478,097 | | 12/1995 | Forma . | |
| 5,480,178 | | 1/1996 | Suk . | |
| 5,515,897 | | 5/1996 | Fehan . | |
| 5,573,112 | | 11/1996 | Kim . | |
| 5,699,906 | | 12/1997 | Lombardo et al. . | |
| 5,816,397 | | 10/1998 | Pratt . | |
| 5,860,519 | * | 1/1999 | Meyer et al. | 206/315.4 |
| 5,918,737 | * | 7/1999 | Kwon | 206/315.3 |

* cited by examiner

*Primary Examiner*—Stephen P. Garbe
*Assistant Examiner*—Tri M. Mai

(57) ABSTRACT

A multi-function golf bag includes an outer bag of a rigid material functioning as a protective and decorative enclosure and being useable as a functional golf bag, a middle bag of a soft material functioning as a containment system for golf clubs and accessories, and an inner bag of a soft material for containing a plurality of golf clubs. The middle bag is adapted to nest within the outer bag and the inner bag is adapted to nest within said middle bag. The middle bag and the inner bag are removable as a unit from the outer bag and the inner bag is removable from the middle bag. The outer bag, the middle bag and the inner bag can be used separately and individually of one another. The golf bag includes a plurality of storage compartments including a duffle bag that removably mounts to a sidewall of the golf bag and a garment bag for storing wearing apparel and which is removably positionable within the golf bag both of which can be used separately and individually of one another and as components of the multi-function golf bag. The golf bag includes a fixed set of wheels located near a lower end of the golf bag and/or a retractable set of wheels mounted on the golf bag near the upper end thereof and which, when deployed, allow the golf bag to be transported oriented in a generally horizontal position.

9 Claims, 24 Drawing Sheets

MULTI-FUNCTION GOLF BAG

BACKGROUND OF THE INVENTION

This invention relates generally to golf bags, and more particularly, to a multi-function golf bag which includes a rigid outer bag and a two-part soft inner bag that is removably disposed and supported in the outer bag. One preferred embodiment includes provision for garment storage within the golf bag.

Conventional golf bags, which are designed for carrying golf clubs and associated equipment, are usually fabricated from a relatively soft material and are open at the upper end to allow access to the clubs contained within the golf bag. Consequently, such golf bags are not suitable for travel, particularly on airplanes or other public transportation. Transportable golf bags having a rigid casing have been proposed. However, such golf bags are relatively heavy and cumbersome for use on a golf course. An alternative arrangement is the provision of a cover of a rigid material for the golf bag that can be used in transporting the golf bag. Such a rigid cover adds weight to the golf bag during transporting of the golf bag. Moreover, such cover does not prevent interference and rattling of the clubs within the golf bag as it is being transported.

A further consideration is that a golfer often wants to carry clothing along with the golf clubs. This can include a golf shirt, a hat, in addition to shoes and other accessories. Such articles of clothing tend to become wrinkled because they are crammed into pockets, or stuffed into the bag along with the golf clubs.

There have been various proposals for making golf bags more mobile. Typically, this involves the addition of wheels to the golf bag, generally located at the bottom of the golf bag, and the wheels can be fixed or retractable. Often, a retractable handle is provided near the top of the golf bag, allowing the bag to be pulled in a generally upright position.

SUMMARY OF THE INVENTION

The present invention provides a multi-function golf bag. In one embodiment, the multi-function golf bag includes an outer bag of a rigid material functioning as a protective and decorative enclosure and being usable as a functional golf bag, a middle bag of a soft material functioning as a containment system for golf clubs and accessories, and an inner bag of a soft material for containing a plurality of golf clubs. The middle bag is adapted to nest within the outer bag and the inner bag is adapted to nest within said middle bag. The middle bag and the inner bag are removable as a unit from the outer bag and the inner bag is removable from the middle bag.

In accordance with preferred embodiments of the invention, the golf bag includes a storage structure which is adapted to fit within the outer bag and which is removably secured to an inner surface of the outer bag. In one embodiment, the removable storage structure comprises a duffle bag that mounts to a sidewall of the golf bag. In another embodiment, the removable storage structure comprises a garment bag for storing wearing apparel, and which is adapted to be positioned within the golf bag. The garment bag is supported within the golf bag spaced from a closed base of the outer bag forming a storage compartment therewithin. The storage compartment is accessible through an opening in a wall of the outer bag which is normally closed by an access door. In accordance with a feature of the invention, a hanging organizer is mounted to an inner surface of the access door and includes a plurality of removable pouches or compartments for storing articles for sporting, personal or travel use.

In accordance with a further embodiment of the invention, the golf bag includes a set of fixed wheels located near a lower end of the golf bag and a set of retractable wheels mounted on the golf bag near the upper end thereof and which, when deployed, allow the golf bag to be transported oriented generally horizontally.

BRIEF DESCRIPTION OF THE DRAWINGS

The features of the present invention which are believed to be novel are set forth with particularity in the appended claims. In one embodiment, the invention, together with the further objects and advantages thereof, may best be understood by reference to the following description taken in conjunction with the accompanying drawings, wherein like reference numerals identify like elements, and wherein:

DETAILED DESCRIPTION OF PREFERRED EMBODIMENTS

Figure 1:
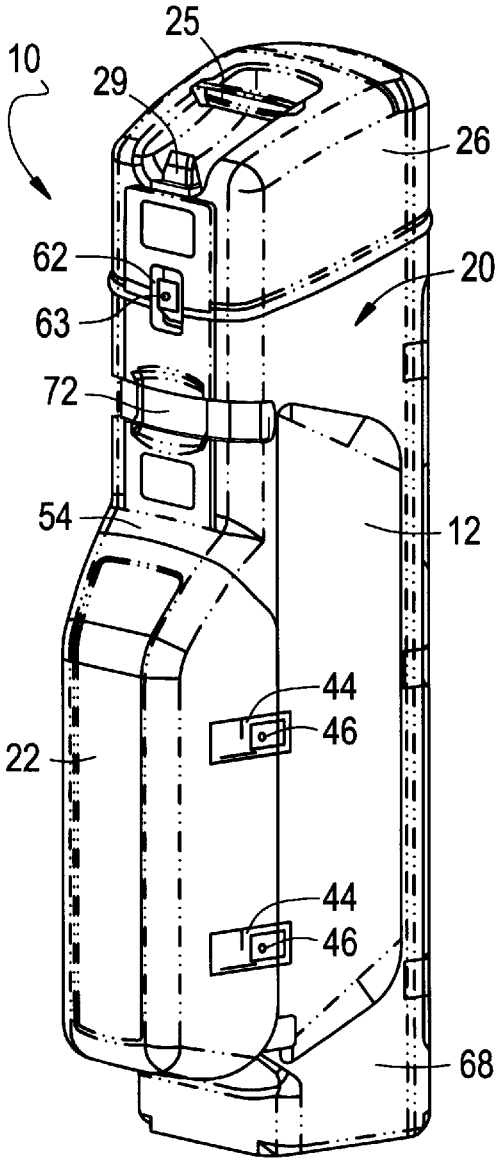
FIG. 1 is an isometric view of a multi-function golf bag provided by the invention.
Figure 2:
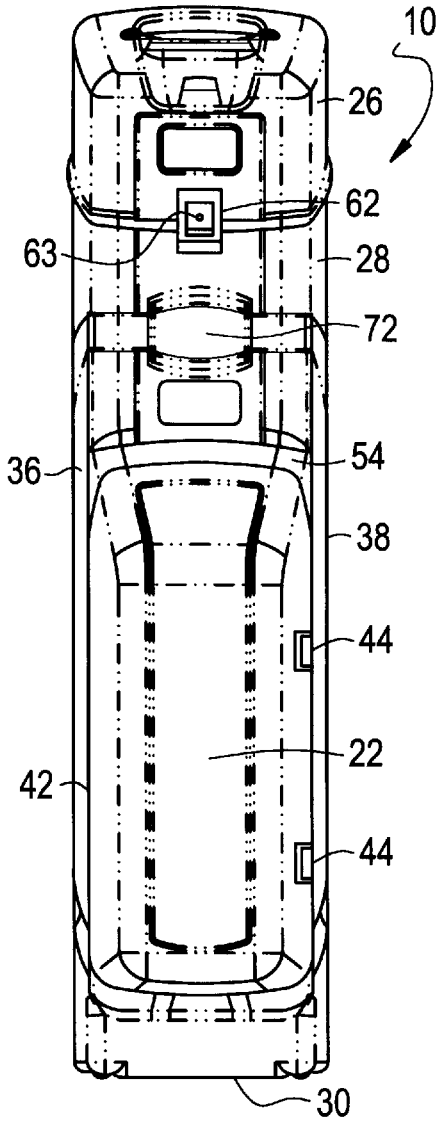
FIG. 2 is a front elevation view of the golf bag of FIG. 1.

By way of description of the invention, the multi-function bag is described with reference to an application to golf. However, the multi-function bag of the present invention can be adapted for other sports, or recreational activities including, but not limited to, baseball, basketball football, and fishing, for example. As will be described, the multi-function bag incorporates features which afford protection and storage of sporting equipment and accessories and for wearing apparel during travel, for example.

Referring to FIGS. 1–4, the multi-function golf bag 10 provided by the invention includes an outer bag or hard side case 12, a middle bag or carry bag 14 and an inner bag or ultra-light bag 16. The components of the multi-function golf bag 10 "nest" with adjacent components to allow for efficient breakout and assembly procedures. The inner bag 16 is adapted to nest in the middle bag 14 and the middle bag 14 is adapted to nest in the outer bag 12. Any of the components of the multi-function golf bag 10 can be used and carried independently, or combined as a whole. For example, the middle and inner bags can be used separately or together as a conventional softsided golf bag for instances when it is desirable to have access to all of the golf clubs. The inner bag 16 can be used as a "Sunday" bag for instances when only a few golf clubs are needed. In preferred embodiments, the middle bag 14, with or without the inner bag 16, functions as a club divider for the outer bag 12. However, the outer bag 12 can be used without the inner and middle bags by employing a club divider as will be shown.

The outer bag 12 functions as a protective and decorative shell, and can be used as a functional playable golf bag. The outer bag 12 can be used as a carry bag, a cart bag, a pull bag and a pull cart bag. The middle bag 14 functions as a standard lightweight golf bag. That is, the middle bag 14 serves as a containment system for golf clubs and the accessories for the game. The middle bag also includes legs forming a stand for the bag. The inner bag 16 serves as a full length club divider for clubs in the middle bag 14 and also can be used as a carry-on for airplane or mass transit, to efficiently and conveniently store clubs for practice range or ultra-lightweight course play, and as a cost effective alternative for beginning golfers, junior golfers, underprivileged, and the elderly, for example.

Outer Bag

Referring to FIGS. 1, 2 and 5–10, the outer bag 12 preferably comprises a four-piece assembly including a body portion or case 20, a front access door 22, a rear access door 24, and a lid 26. Alternatively, the multi-function golf bag can be molded in two pieces utilizing a full length hinge, molded in a clam shell configuration, or can be formed as a one-piece unit that is open at its upper end and closed at its lower end. A multi-function golf bag incorporating the clam shell configuration can also have hinged doors. One or both sides can have a concave or slight hourglass shape for ergonomics during handling. In FIGS. 1, 2 and 5–7, hidden lines are represented by dot dashed lines.

Figure 10:
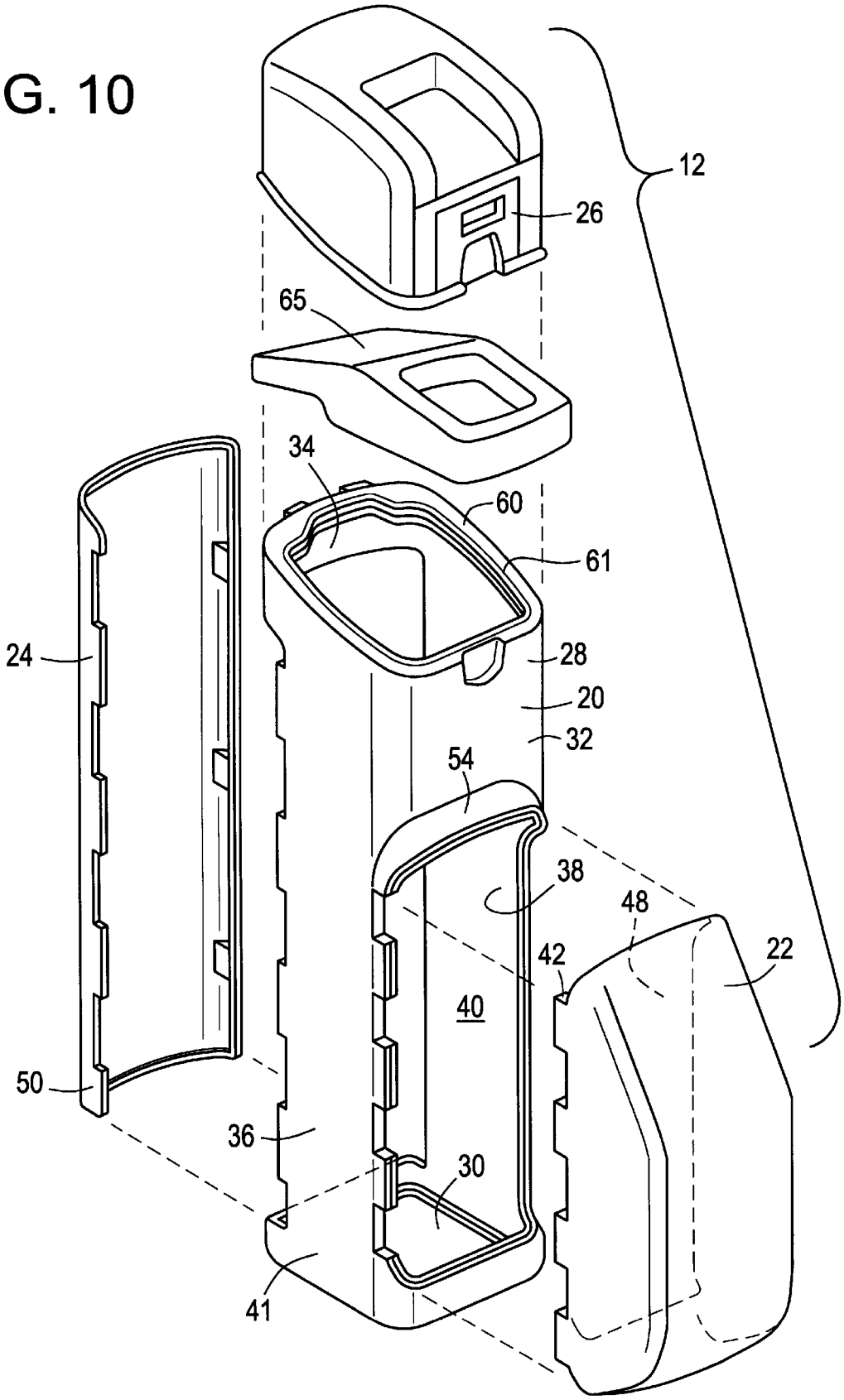
FIG. 10 is an exploded view of the outer bag or hard side case of the golf bag.
Figure 11:
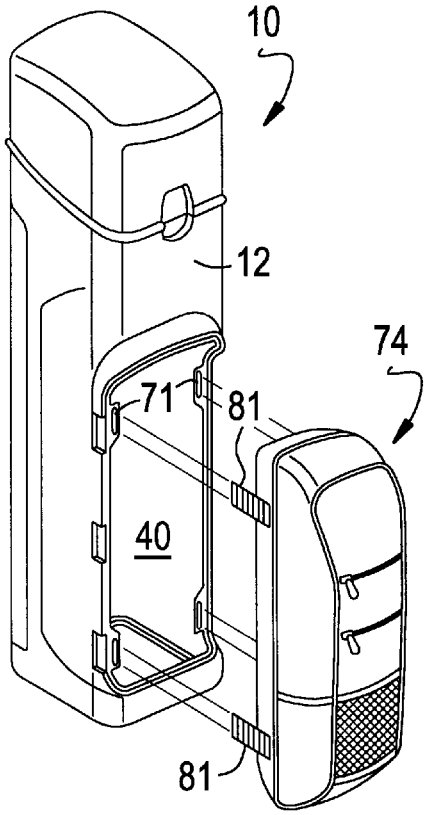
FIG. 11 is an isometric view of the golf bag with the front storage duffle bag assembly shown removed.
Figure 12:
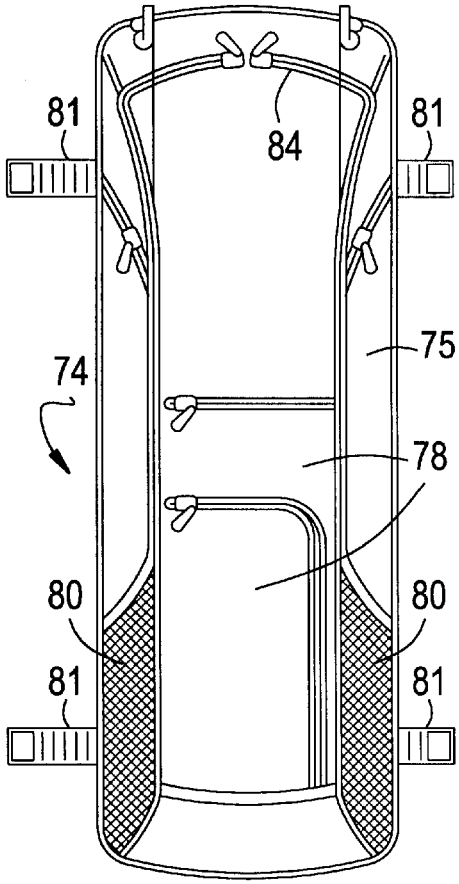
FIG. 12 is a front view of the front storage duffle bag assembly.

As shown in FIG. 10, which is an exploded view of the outer bag (with hardware such as latches, locks, straps, etc. omitted) the body portion 20 is open at its upper end 28 and includes a closed base 30, a front wall 32, a rear wall 34, and a pair of sidewalls 36 and 38. The front wall 32 has an opening 40, providing access to the interior of the body portion 20. The opening 40 extends transversely between the vertically extending sidewalls and extends vertically from just above the lower end 41 of the outer bag 12 to an outwardly directed, transversely extending lip 54 that is located about one-fourth the distance from the upper end 28 the body portion 20. In one embodiment, the front access door or cover 22 is hinged to the body portion 20 along one edge 42, preferably by a molded in hinge, or by a piano hinge, or separate hinges. The front access door 22 can include a pair of snap locks or latches 44 for maintaining the front access door in its closed condition. Optionally, one or more of the snap locks or latches 44 can also include a lock 46 for securing the door 22 in its closed position. Alternatively, the front access door 22 can be configured to be received on the body portion by a snap fit, allowing the front access door to be removed. The front access door 22 bows outwardly, defining an internal storage compartment 48 at the front of the multi-function golf bag. The hinged (or snapfit) construction allows for removal of the front access door 22 from the body portion 20.

Similarly, in another preferred embodiment, the rear access door or cover 24 is hinged at one side 50 thereof to the body portion 20 preferably by a molded in hinge, or by a piano hinge or separate hinges. The rear access door 24 preferably defines a substantial portion of the rear of the golf bag and provides access to the interior of the body portion 20 to allow the middle bag to be positioned within the outer bag. Alternatively, the rear access door 24 can be configured for snap-fit mounting on the body portion 20. The rear access door 24 includes three snap locks or latches 56 for maintaining the rear access door 24 in a closed position. Optionally, one or more of the snap locks or latches 56 can include a lock 58 for securing the door 24 in its closed position. The hinged (a snapfit) construction allows for removal of the rear access door 24 from the body portion 20. A night light 59 can be mounted on the exterior of the golf bag 10. In one embodiment, the light can be mounted in the rear access door near the upper end thereof or at any other suitable location on the golf bag 10. The light can be maintained steady on for illuminating walkways, and can blink intermittently for safety and visibility.

Figure 8A:
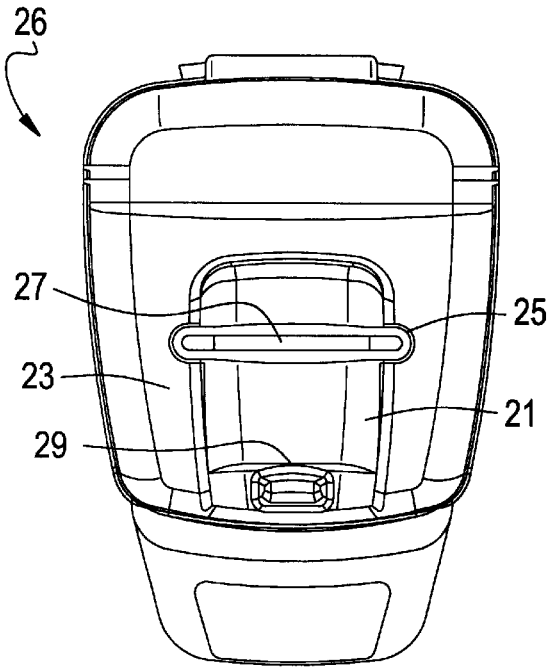
FIG. 8A is a top plan view of the golf bag of FIG. 1 including a lid in accordance with one embodiment of the invention, FIG. 8B being a front elevation view of the lid of FIG. 8A.
Figure 8C:
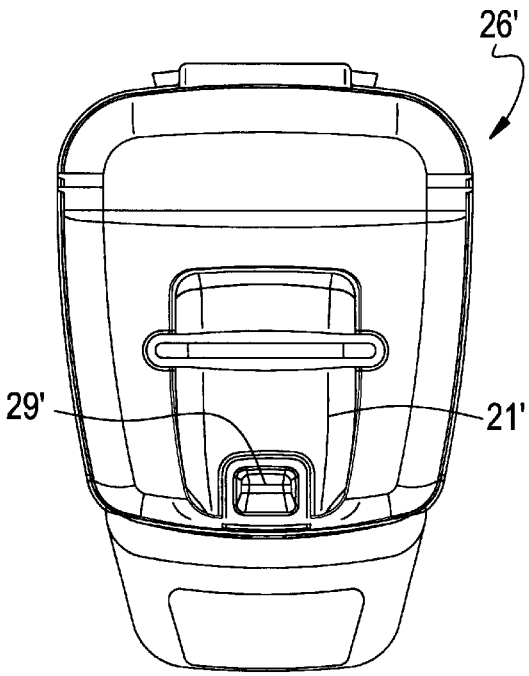
FIG. 8C is a top plan view of the golf bag of FIG. 1 including a lid in accordance with a second embodiment, FIG. 8D being a front elevation view of the lid of FIG. 8C.
Figure 8B:
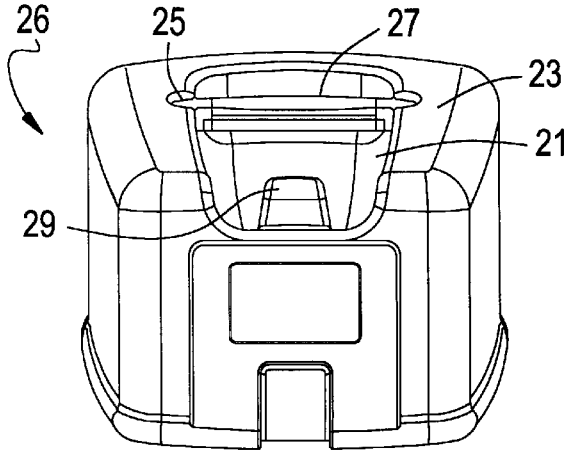
Figure 8D:
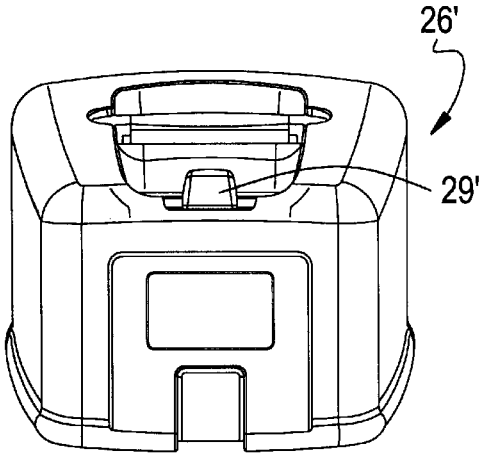

The upper end or mouth of the body portion 20 preferably includes an inwardly directed flange 60 which defines a mounting surface for a club head nest 160 (FIG. 4) as discussed further below. As shown in FIGS. 8A and 8B, the lid 26 has a recess or pocket 21 in its top surface 23. A transverse slot 25 in the pocket 21 locates a molded handle 27 which is secured to the lid in any suitable manner. A hook 29 projects vertically within the pocket 21 near the front side of the lid. For travel convenience, the hook-like element 29 can be used for piggybacking additional luggage. A strap or handle of the piggyback luggage can be located to engage the hook-like element 29 as the body of the luggage rests upon outer bag 12. FIGS. 8C and 8D show a further embodiment for a lid 26' in which the pocket 21' is more shallow than pocket 21, affording more space in the interior of the lid 26' for accommodating larger size clubs. The vertical hook 29' is shorter than hook 29.

Figure 3:
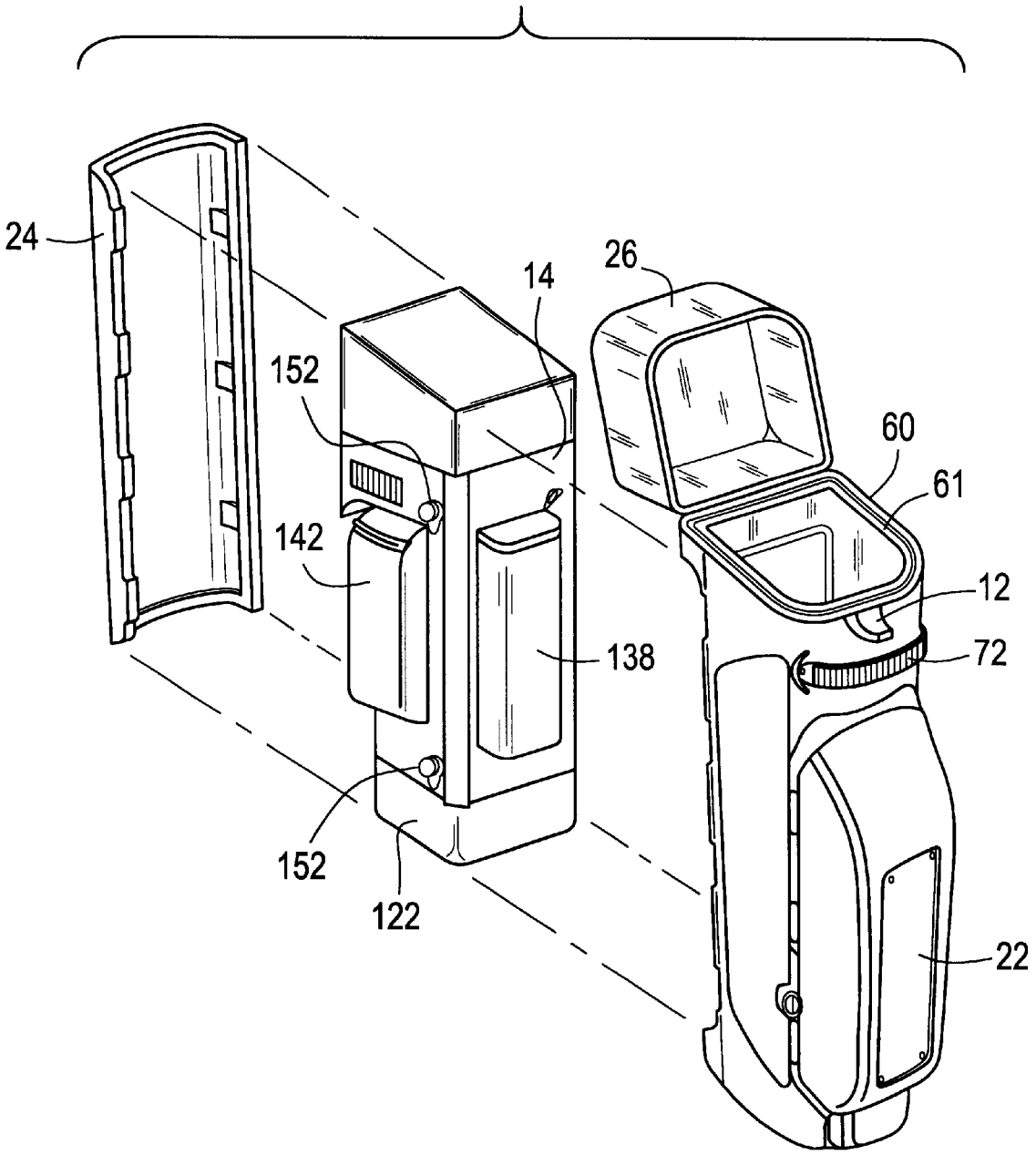
FIG. 3 is a partially exploded view of the golf bag showing the outer bag along with an assembly of the middle and inner bags.

The lid 26 is adapted for mounting on the flange 60, and the mounting flange includes an upwardly extending lip 61, shown in FIG. 3, for locating the lid 26 on the body portion flange 60 and on the outer side of the lip 61. The lid 26 has sufficient perimeter overlap or interlock with the body portion 20 of outer bag 12 to avoid separation due to twisting or torque. The lid 26 includes a locking latch 62 at the front wall and a releasable hinge 64 at its backside. In addition, the lid 26 can include a security lock 63 at the front wall. The top cover or lid 26 of the outer bag 12 is hinged to the upper end 28 of the body portion 20 and is removable therefrom. The compartment defined by the top cover 26 does not require access during transport. The top cover can include a locking mechanism (or its release) that is accessible only via security locking compartment. Such locking mechanism can be as simple as a pivoting or spinning inverted T, that is manually engaged/disengaged.

Referring again to FIG. 10, a pad element 65 can be mounted in the lid 26. The pad element 65 within the cavity of the lid 26 can be securely positioned in a suitable manner, such as by conventional hook and loop type fasteners or function fit. In its fully open position, the lid 26 rests against the back upper portion of the outer bag 12 (FIG. 3), thus exposing the inside padded walls of the lid and creating an open storage trough.

Alternatively, the padding within the cavity of the cover 26 can be provided by the fabric top cover of the middle bag 14. In such embodiment, the fabric top folds into an appropriately cushioning form and is securely positioned in a suitable manner, such as by a hook and loop type fastener or by straps.

Figure 5:
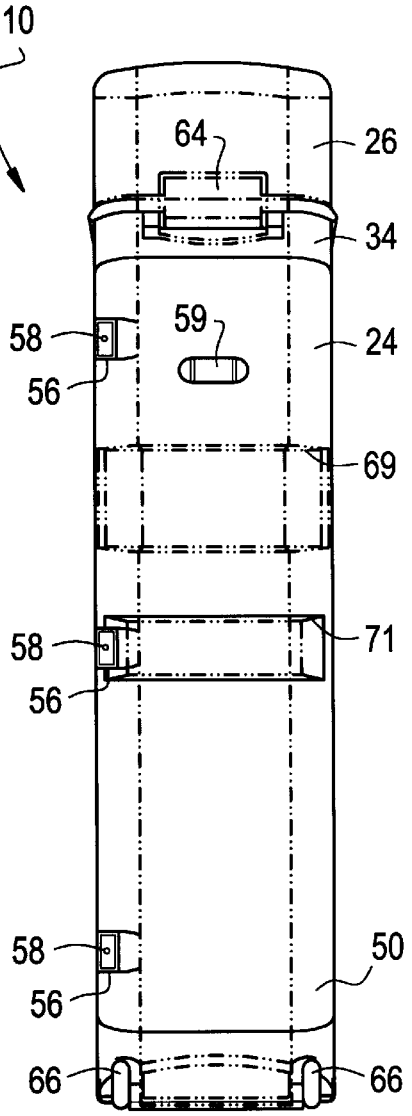
FIG. 5 is a rear elevation view of the golf bag of FIG. 1.
Figure 6:
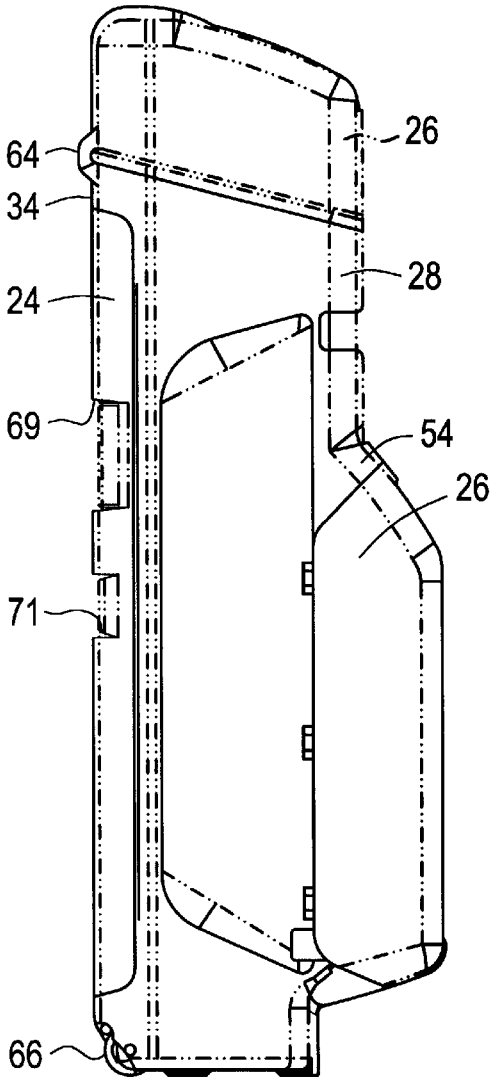
FIG. 6 is a left side view of the golf bag of FIG. 1.
Figure 7:
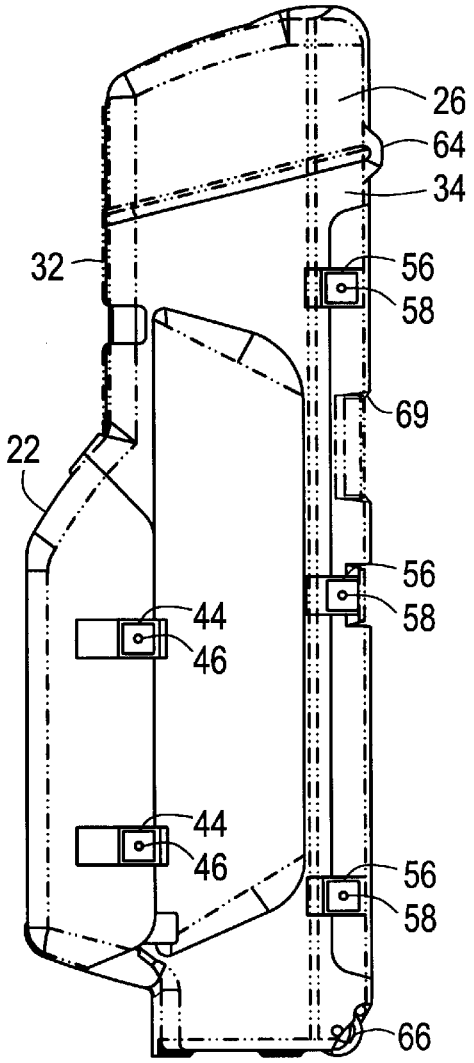
FIG. 7 is a right side view of the golf bag of FIG. 1.
Figure 9A:
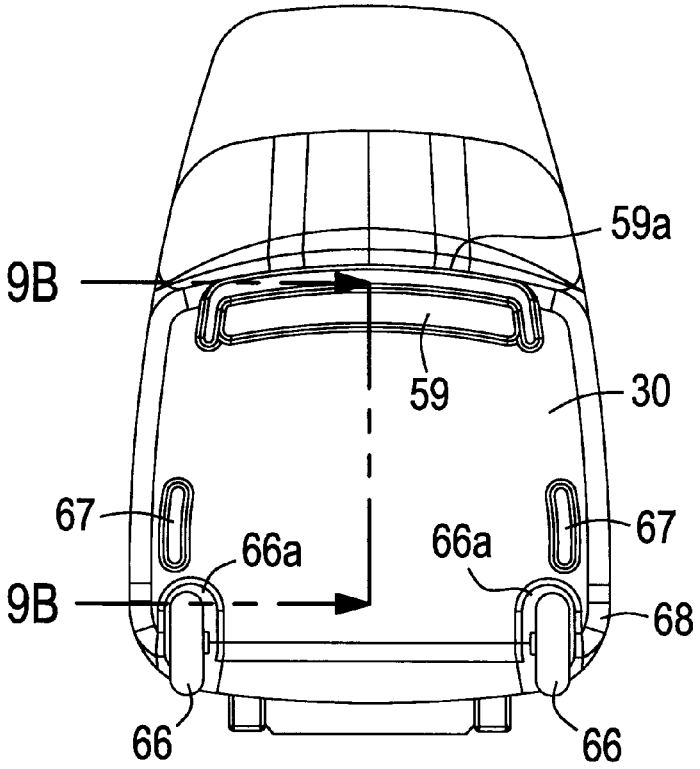
FIG. 9A is a bottom view of the golf bag of FIG. 1.
Figure 9B:
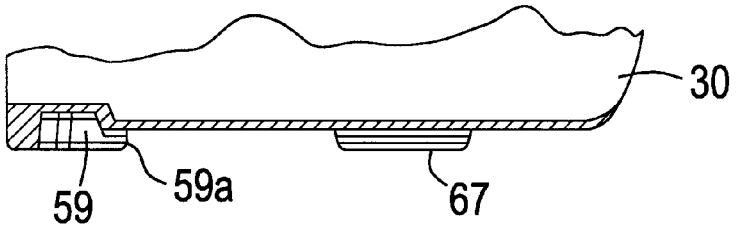
FIG. 9B is an enlarged, fragmentary view taken along the line 9B—9B of FIG. 9A.

Referring to FIGS. 5, 9A and 9B, the bottom or base 30 of the body portion 20 includes a pair of wheels 66 to facilitate transporting of the golf bag 10. The base 30 also includes a pair of standoffs 67. A pocket or slot 59 in the base functions as a finger grip, which, together with a strap handle 72 on the front side of the body portion 20 (FIG. 1), facilitates lifting of the golf bag 10. The pocket 59 can be approximately ¼ inch deep. A generally U-shaped rim 59*a* extends along the pocket on side thereof. The rim 59*a* projects out from the surface of the base 30 an amount corresponding to the height of the standoffs 67. The finger grip can be about ¼ inch to ½ inch deep. The wheels 66 are located in wheel wells 66*a* at the rearward bottom edge 68 of the body portion 20, standoffs 67 and the rim 59*a*, which extend down from the exterior surface of the lower end or base of the outer bag 12, provide footing to allow the golf bag 10 to stand upright on level ground. In most, if not all, pull cart applications the wheels 66 are substantially offset from the base of the multi-function golf bag 10, thus creating a stable, tripod platform when the golf bag 10 left on level or substantially uneven terrain. Preferably, the wheels 66 are fixed, with the wheels being mounted in the bottom of the outer bag 12, at opposite sides thereof.

Alternatively, retractable wheels can be incorporated in the golf bag 10 in which case, the outer bag 12 can include hardware on the golf bag 10 to enable extension and retraction of the two wheels. When retracted, the wheels and associated hardware can lock into a cavity within the footprint/perimeter of the case. This compactness allows for a sleek appearance and minimizes snags during airline and other transport. Moreover, the wheel assembly can be embodied as an accessory that is adapted to mount on the golf bag and function as a pull cart for the golf bag. When extended and locked into position, the wheel base can, for example, be approximately twenty-four inches. However, other wheel bases can be used. In one preferred embodiment, the rear wall 34 of body portion 20 can includes a cut out 69 to facilitate the mounting of the golf bag 10 on a driven cart, and a further cut out 71 to facilitate the mounting of the golf bag 10 on a pull cart. However, the body portion 20 can have a rear wall without such cutouts 69 and/or 71.

Figure 4:
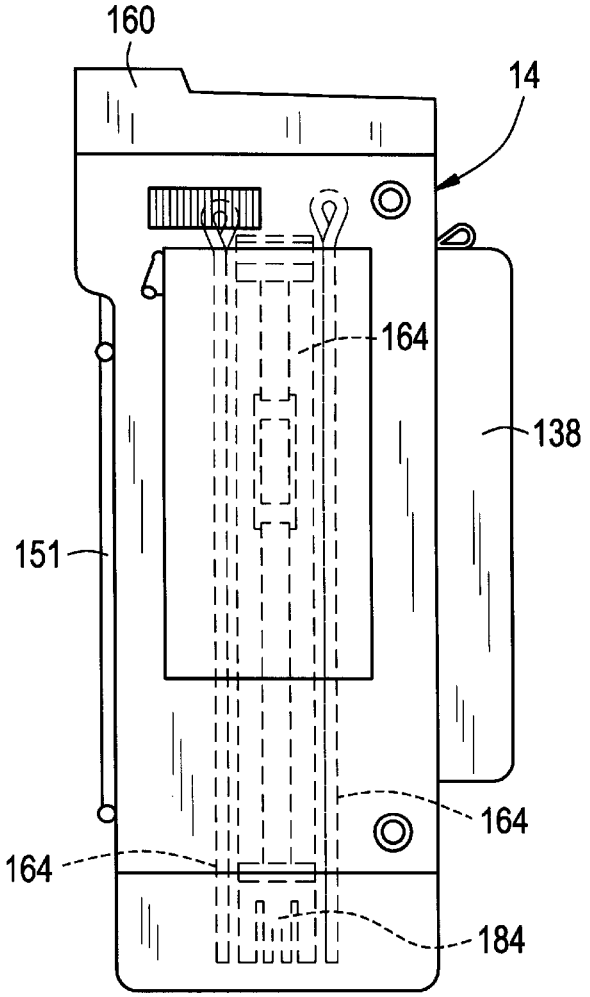
FIG. 4 is a side view of the assembly of the middle and inner bags with the inner bag shown in phantom.
Figure 14:
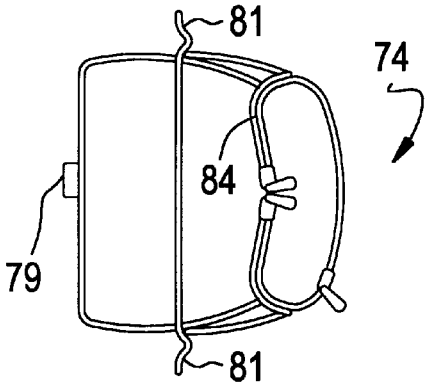
FIG. 14 is a top plan view of the front storage duffle bag assembly.
Figure 15:
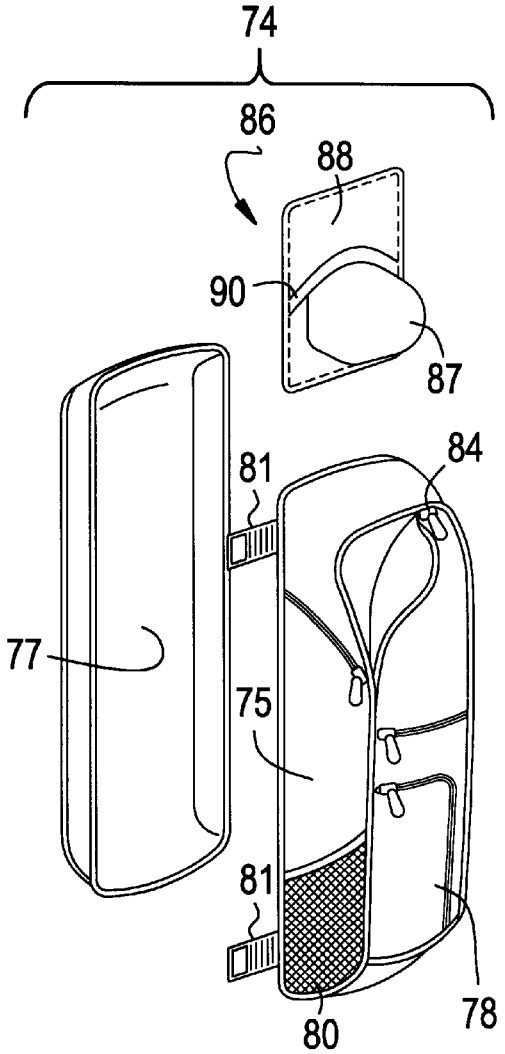
FIG. 15 is an exploded view of the front storage duffle bag assembly illustrating a hat support for use therewith.
Figure 13:
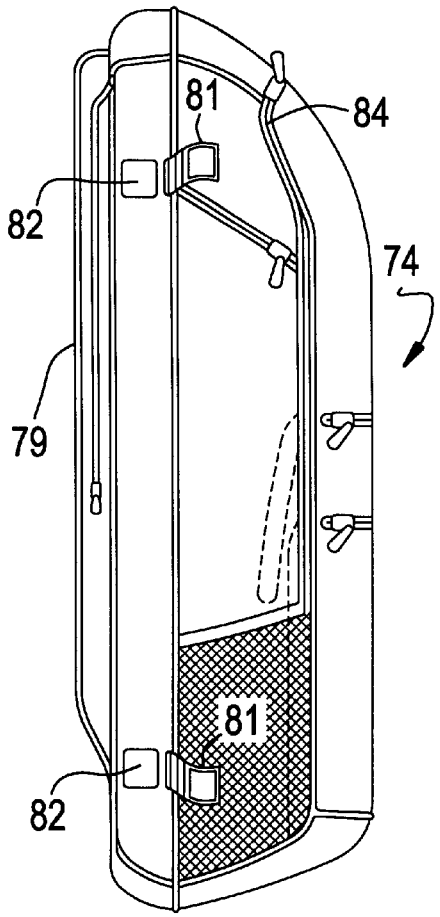
FIG. 13 is a left side view of the front storage duffle bag assembly.
Figure 16D:
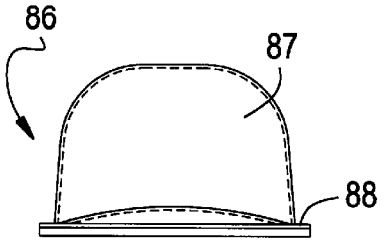
FIGS. 16A–16E are views of the hat support shown in FIG. 15.
Figure 16A:
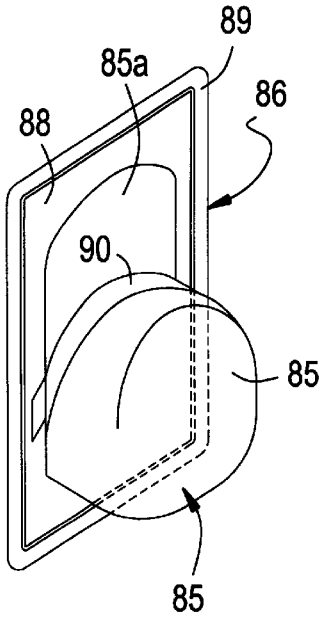
Figure 16B:
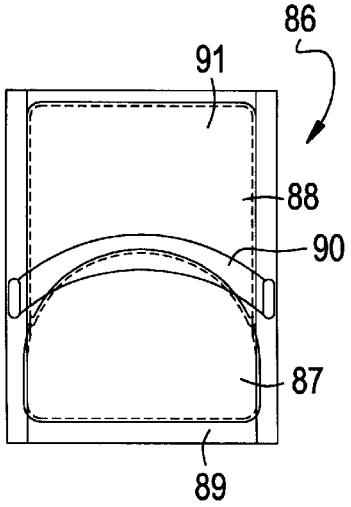
Figure 16E:
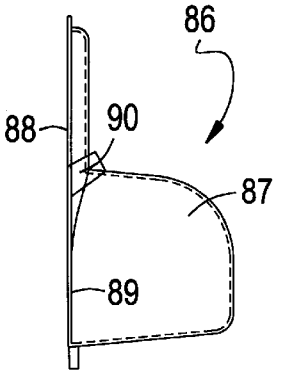
Figure 16C:
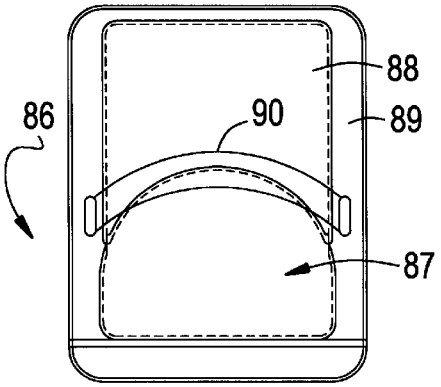

Referring to FIGS. 11–15, in accordance with a feature of the invention, a duffle bag assembly 74 is removably mounted over the opening 40 in the front wall of the outer bag 12. The duffle bag assembly 74 can be enclosed within the front storage compartment 48 by mounting the front access door 22 (FIG. 10) on the golf bag 10. Alternatively, the duffle bag assembly 74 can function as a soft-sided storage compartment at the front of the golf bag 10. Moreover, the duffle bag assembly 74 can be removably mounted on the middle bag, functioning as the storage bag 138 (FIGS. 3 and 4). The duffle bag assembly 74 includes a duffle bag 75 and a cap or hat support 86 which, in one preferred embodiment, is mounted on a base 77 of the duffle bag 75. The duffle bag 75 and the base 77 can be made of nylon or other soft material, for example. In one embodiment, the duffle bag 75 includes a plurality of zippered pockets 78 and mesh pockets 80 at the lower end of the duffle bag 75. The duffle bag 75 includes a shoulder strap 79 and the duffle bag can be used separately from the golf bag 10. The duffle bag assembly 74 can be removably secured to the body portion 20 of the outer bag 12 in any suitable manner, such as by conventional hook and loop type fasteners including webbing straps carrying hook type material 81 , which loop through slots 71 in the inside wall of the body portion 20, and loop type material 82 mounted on the side of the duffle bag 75 as shown in FIG. 14. A zipper 84, closes an opening through which the access to the interior of the duffle bag 75 is provided.

Referring also to FIGS. 16A–16E, in accordance with another feature of the invention, a cap or hat support 86 can be mounted on the base 77 of the duffle bag assembly 74 for providing storage for a golf hat, baseball-type sports cap 85 (FIG. 16A), and the like, hereinafter referred to as "hat", and for maintaining the form of the hat by eliminating crushing when packed. The hat support 86 includes a hat form 87 formed integrally with a base 88 with a peripheral flange 89, preferably by injection molding, vacuum forming, etc. A strap 90, such as an elastic band or the like, is secured to the base 88 for securing the bill of the hat or cap to the base. Access to the hat support 86 can be had through the opening in the duffle bag provided when zipper 84 is unzipped.

Preferably, the hat form 87 is molded as a ¼ sphere or greater for use in maintaining the shape for a baseball style cap 85 having a bill 85*a*, when the back half of the cap is pushed in to nest with the front half of the body 85*b* of the cap 85. The strap 90 extends along the front of the cap 85 generally overlying the junction between the body 85*b* of the hat and the bill 85*a*. Alternatively, the hat support can be molded large enough to hold the cap in its unfolded condition. A textile cover 91 (FIG. 16B) can be secured to the hat support, or can be provided as a separate element, for protecting the hat from soiling. In one embodiment, the textile cover 91 is fixed to one end of the case with the other end removably secured to the base 88, as by conventional hook and loop type fasteners. In addition, the hat support can be produced in different sizes and can be formed to hold more than one hat at a time. Also, the hat support can be used separately with other duffle bags, or in lockers or with sporting equipment, etc., either mounted in the bag or are loose in the bag as a removable accessory.

In addition, the golf bag 10 can further include a variety of components for effectively securing wearing apparel during transport (i.e. hanger, straps, netting, etc.) to minimize soiling and wrinkling. The duffle bag can embody these features.

Figure 17A:
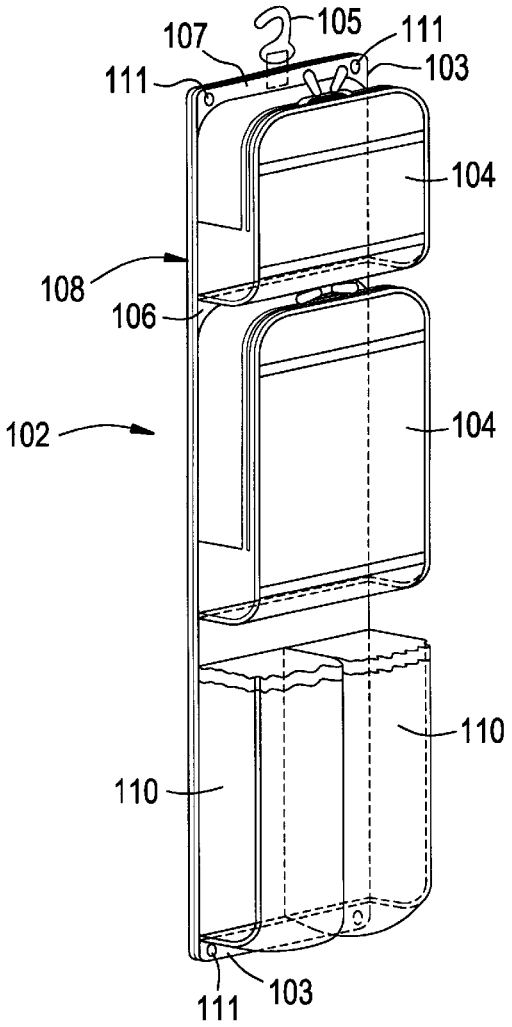
FIG. 17A is an isometric view of a rear door organizer of the golf bag of FIG. 1.
Figure 18A:
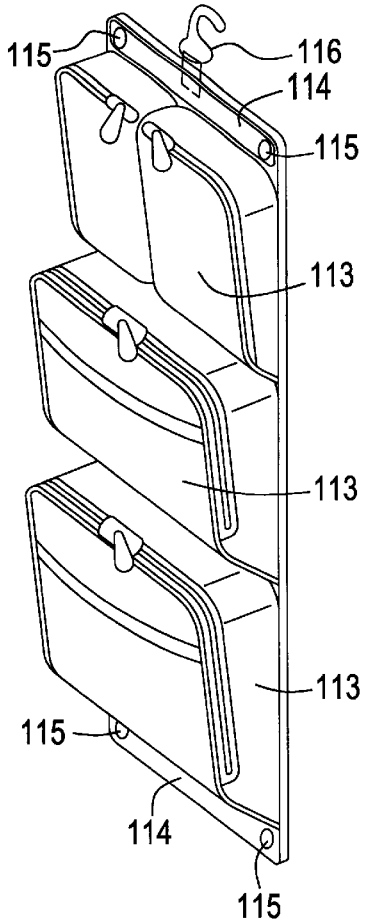
FIG. 18A is an isometric view of a front door organizer of the golf bag of FIG. 1.
Figure 17B:
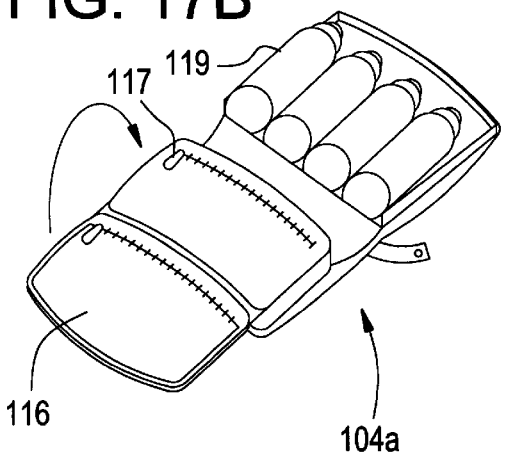
FIG. 17B shows a removable toiletry bag for mounting on the rear door organizer of FIG. 17A.

Referring to FIG. 17A, a hanging organizer 102 is adapted to be mounted in the rear access door 24 (FIG. 10). The organizer 102 includes a plurality of zippered pouches 104 disposed on the forward surface 106 of a support member 108. The organizer further includes a pair of expandable shoe pockets 110 at the lower end thereof. The golfer's golf shoes normally can be stored in the pockets and the golfer's street shoes can be stored in the pockets during lodging. Typically, these storage devices are removed at the hotel or other place of lodging for the golfer. The organizer 102 can include a plastic stiffener 103 or the like, or webbing or strapping at the upper end, or at the upper and lower ends. The organizer 102 includes a hanger hook or fabric loop 105 attached to the upper stiffener 103 by webbing strap 107. By way of example, the organizer 102 can be removably secured to the inner surface of the rear access door 24 by snap fasteners 109. The front access door 22 (FIG. 10) also can include a hanging organizer 112 including zippered pockets 113 as shown in FIG. 18A in place of or in addition to the garment bag assembly 74 (FIG. 1l). The organizer 112 includes stiffeners 114 or the like, or webbing or strapping at the top, or at the top and bottom. The organizer 112 can be attached to the inner surface of the door 22 by snap fasteners 115, and can include a hanger hook or fabric loop 111 attached to the upper stiffener 114. Both or one of the two hanging organizers can be outfitted for golf use, and the other for personal or travel use. For example, one of the storage pouches 104 can be a removable, fold-up toiletry bag, such as bag 104*a* shown in FIG. 17B. The bag 104*a* includes a mesh pocket 116 adapted to fold over a zippered inner pocket 117 and which together can be closed by a zipper over a toiletry compartment 118. The bag 104*a* can be attached to the organizer 112 in any suitable manner, such as by conventional hook and loop type fasteners.

Figure 18B:
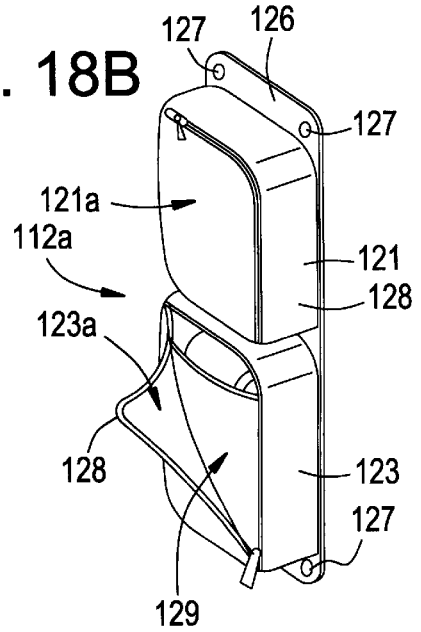
FIG. 18B shows a removable food and beverage organizer of the front door organizer of FIG. 18A.
Figure 19D:
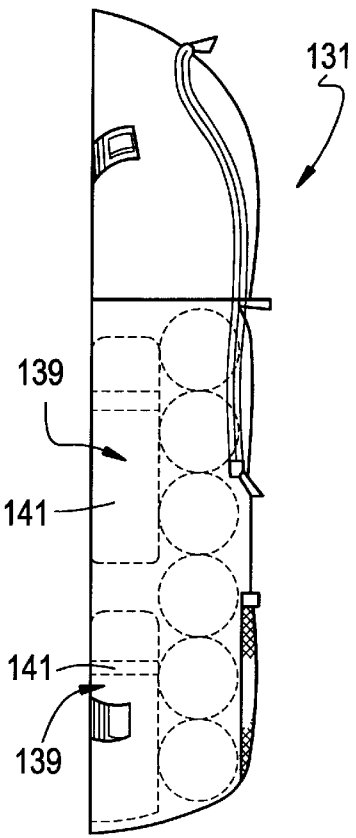
FIGS. 19A–19D show a front storage food and beverage organizer of the golf bag of FIG. 1.
Figure 19C:
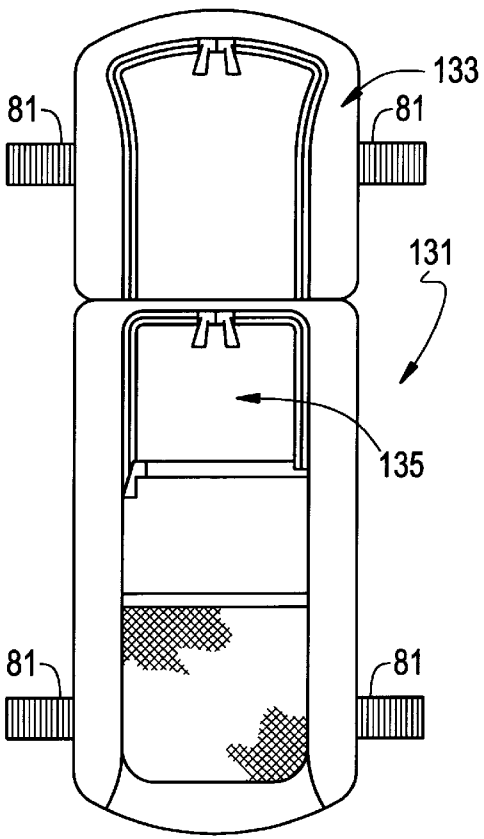
Figure 19B:
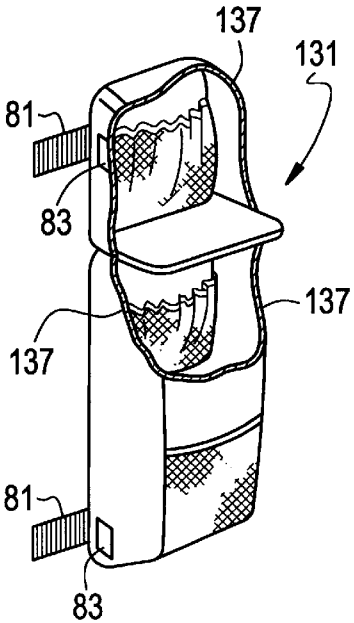
Figure 19A:
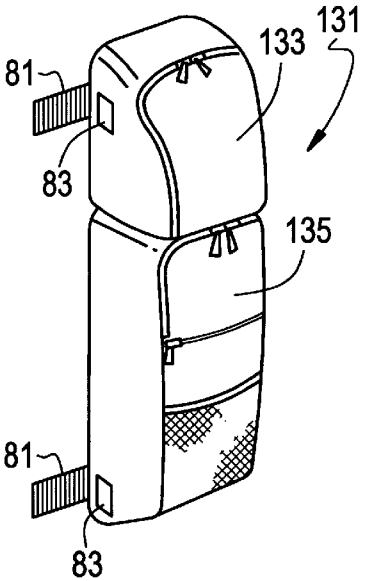

Referring to FIG. 18B, in accordance with a further embodiment, an organizer 112*a* for the front access door 22 includes a top pocket 121 with a zippered flap 121*a* and a bottom pocket 123 with a zippered flap 123*a*, the pockets 121 and 123 being secured to a support 126. The support 126 is adapted for removable mounting to the inner surface of the front access door 22 by snap type fasteners 127 or the like. All of the walls 128 of both pockets are insulated so that the pockets can contain food items or beverages. For example, pocket can contain sandwiches or the like. Pocket can contain a plurality of canned beverages. Pocket includes a mesh 129 which secures the food items or beverages contained therein when the flap is opened.

Preferably, the depth of the doors 22 and 24 ranges between about four inches to about eight inches. However, other door depths can be employed. Alternatively, a retrofit door extension can be provided to offer the user selected options as to the depths of the doors.

With the front access door 22 removed, or open, the duffle bag 75 presents a softside appearance and with the pockets 78 and 80, as well as the interior of the bag 75 accessible from the front of the golf bag 10. The front access door 22 can be closed and security snap locked over the softside compartment for protection.

The opening 40 of the outer bag can be closed by an internal recessed wall (not shown), and such wall, or a portion thereof, can be adapted to be removable to create a pass through into the interior of the outer bag. Consequently, when the middle bag 14 is inserted into the outer bag 12, such opening can offer direct access to the middle bag 14 and its compartments. In addition, when the duffle bag is mounted on the middle bag and the middle bag is located within the outer bag, such pass through allows for exposure of the decorative "softsided" features of the fabric to enhance the golf bag unit. This feature requires that the protective outer bag front door be completely removable from the outer bag 12.

Referring to FIGS. 19A–19D, there is shown a front storage food and beverage organizer 131 which is adapted to be removably mounted over the opening 40 (FIG. 10) in the front wall of the outer bag 12 in place of the duffle bag assembly 74. The food and beverage organizer includes a zippered top pocket 133 and a zippered bottom pocket 135. The food and beverage organizer can include conventional hook and loop type fasteners 81 and 83 on straps which are adapted to pass through the slots 71 in the inner surface of the front access door as described above with reference to duffle bag assembly 74. All of the walls 137 of both pockets 133 and 135 are insulated so that the pockets can contain food items or beverages. For example, the upper pocket can contain sandwiches or the like.

The lower pocket can contain a plurality of canned beverages. The lower pocket includes one or more pouches 139 for holding freezable ice packs 141.

Middle Bag

Figure 20:
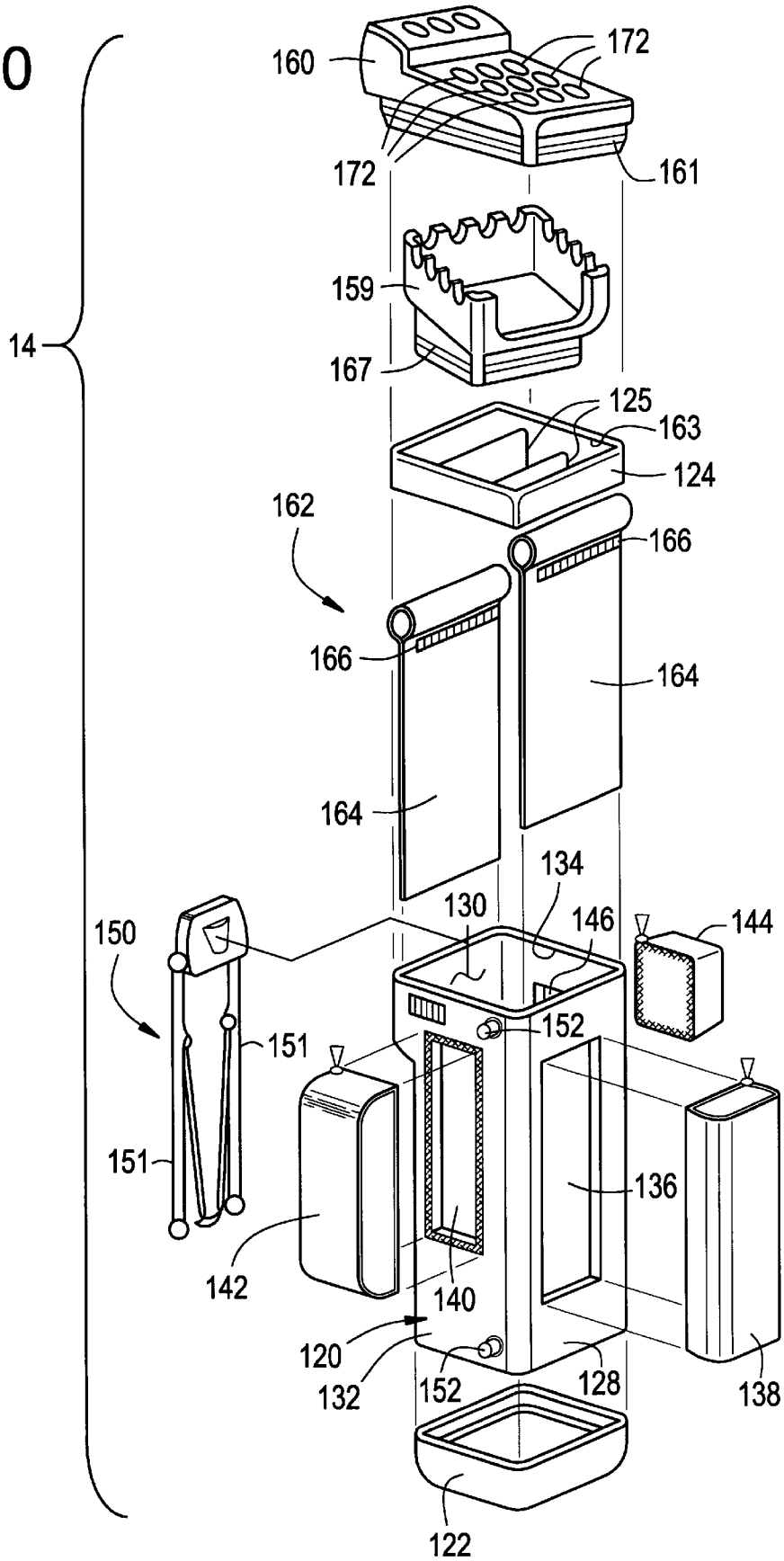
FIG. 20 is an exploded isometric view of the middle bag of the golf bag of FIG. 1.
Figure 21:
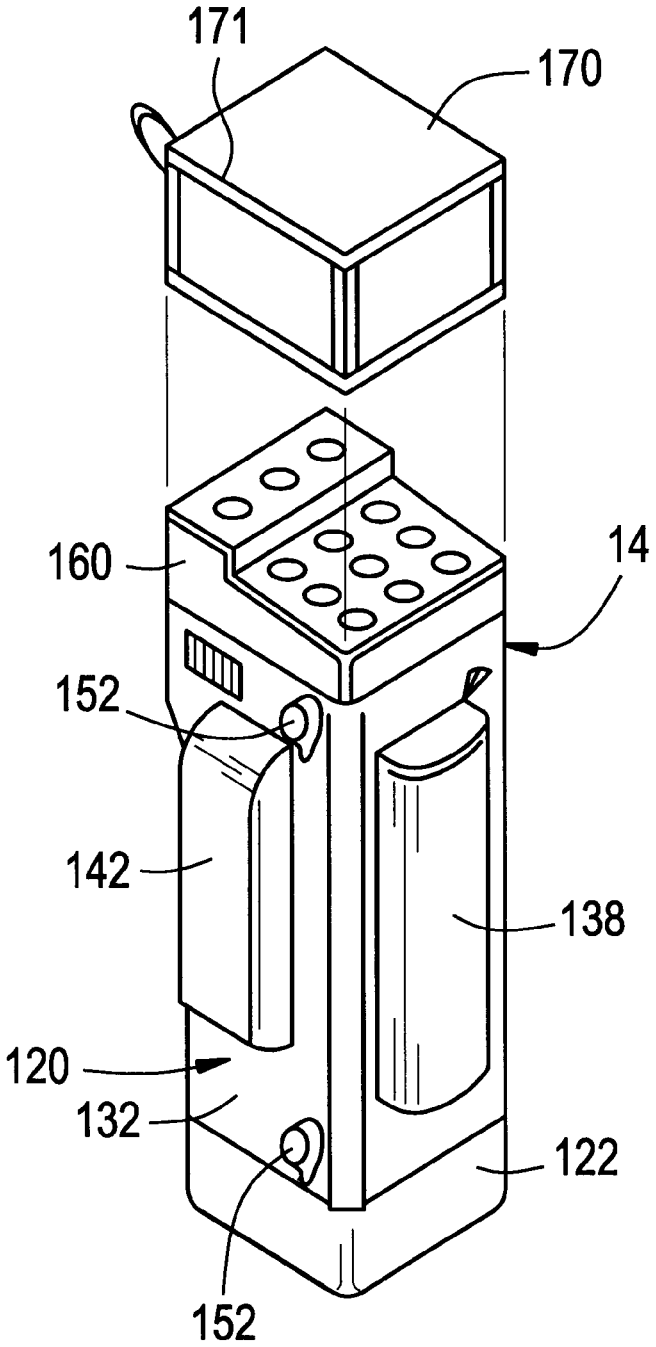
FIG. 21 is an isometric view of the middle bag shown assembled.
Figure 22:
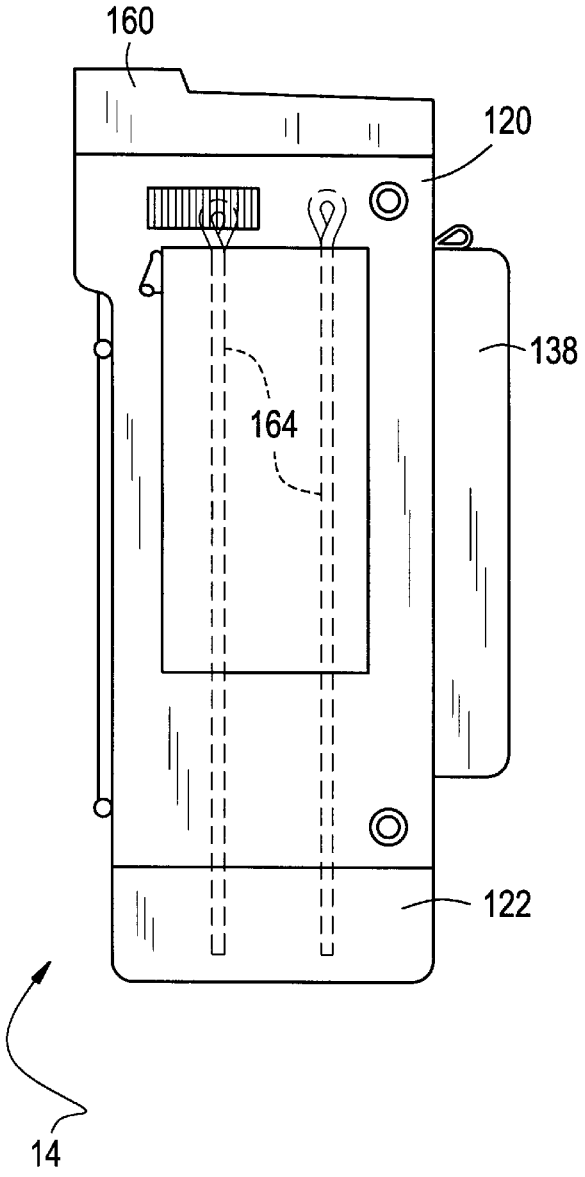
FIG. 22 is a side view of the middle bag of the golf bag.

Referring to FIGS. 20–22, the middle bag 14 can be generally rectangular or triangular in cross section and includes a body portion 120 and a bottom 122. The middle bag body portion 120 is made of a soft material, such as nylon. The bottom 122 is molded and is attached to the body portion 120 of the middle bag 14 in a suitable manner. The middle bag 14 also includes a molded upper rim or mouth portion 124, and/or other suitable retainers (not shown), which mounts in the mouth of the middle bag 14 for maintaining open the upper end or mouth of the middle bag 14. The rim 124 includes parallel extending rectangular slots 125 which extend vertically therethrough. The profiles of the upper and bottom rims can generally match the profile of the flange 60 (FIG. 10) of the outer bag 12. The rim 124 can be maintained in the mouth of body portion 120 by interference fit or can be secured thereto in any suitable manner.

The body portion of the middle bag 14 includes a front wall 128, a back wall 130 and a pair of side walls 132 and 134. The front wall 128 includes a substantially rectangular opening 136 in which is removably mounted a zippered storage pouch 138 by a zipper or by conventional hook and loop type fasteners. The side wall 132 includes an opening 140 in which is removably mounted a further zippered storage pouch 142. A further pouch 144 is mounted in an opening 146 in the other side wall 134. In addition, the middle bag 14 includes a foldable bag support 150 that is mounted on the back wall 130 of the body portion 120.

Figure 23:
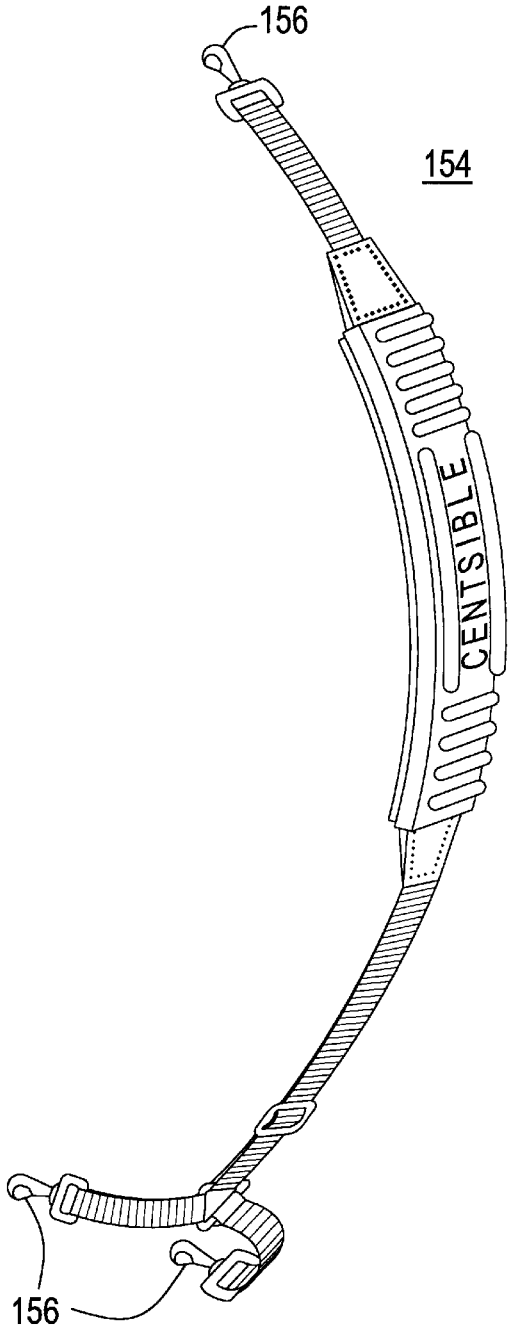
FIG. 23 is an perspective view of a shoulder strap for the middle bag of the golf bag.

The middle bag 14 includes a bag stand system with two leg supports 151 which push out and away from the bag upon impact with the ground, creating a tripod stand The side wall 132 includes a pair of rings 152, and a further ring (not shown) on side wall 134, for attaching a shoulder strap 154, shown in FIG. 23, when the middle bag 14 is used separately from the outer bag 12. The strap 154 attaches to the outer bag 12 by way of clips 156. The body portion 30 of the outer bag 12 can be provided with such mounting rings 157 to allow mounting of the shoulder strap on the outer bag 12 allowing the shoulder strap 154 to be shared by both the outer bag 12 and the middle bag 14. Alternatively, a backpack style, dual strap option can be used.

Figure 27:
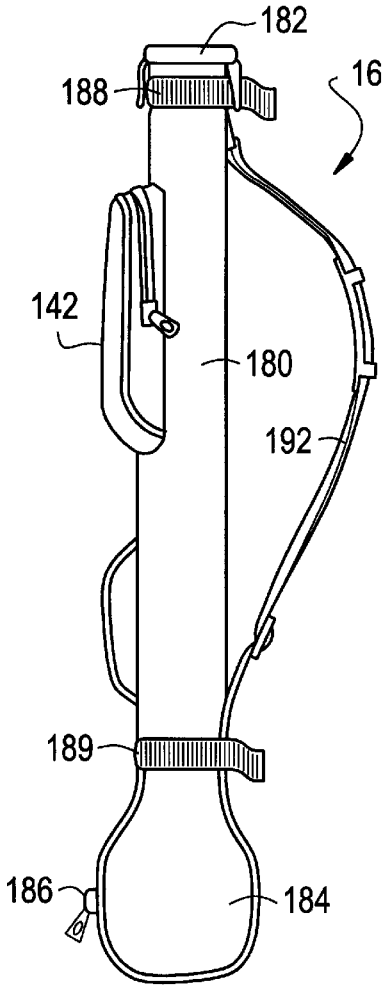
FIG. 27 is a side view of the inner bag of FIG. 26.
Figure 28:
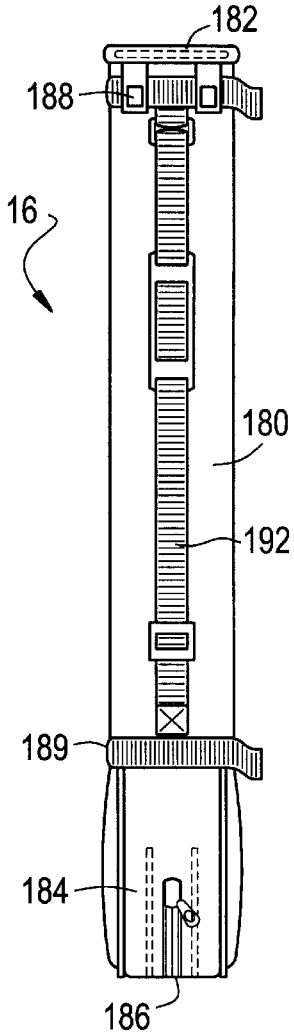
FIG. 28 is a front view of the inner bag.
Figure 30:
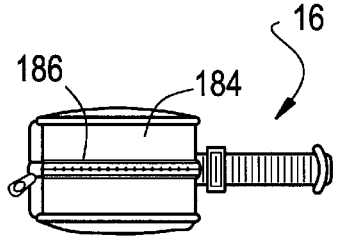
FIG. 30 is a bottom view of the inner bag.
Figure 31:
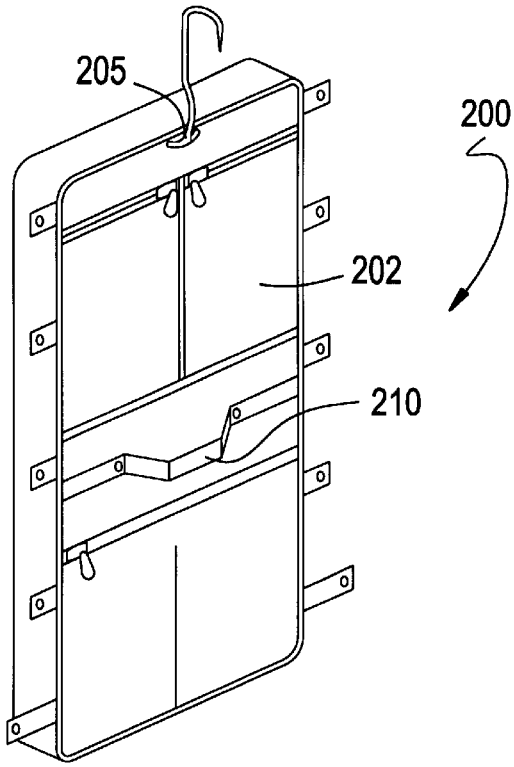
FIG. 31 is an isometric view of a garment bag for use in the golf bag of FIG. 1.

The middle bag 14 storage compartments are removable, transferable and/or interchangeable. For example, storage compartment 142 can be transferred to the inner bag 16 (FIG. 27). This feature offers the user the flexibility to choose how he wishes to outfit the bag, distribute the weight, and change color to current preference.

In addition, the middle bag 14 includes a club head nest 160 and a full length divider 162 for the golf clubs. Club head nests of this type are known in the art as exemplified by the club head nests disclosed in U.S. Pat. No. 5,458,240, which is incorporated herein by reference for its disclosure as to club head nests. The club head nest 160 can be molded of foam or rubber and includes a generally rectangular or triangular base that is adapted to be mounted on the rim 124. The bottom surface of the base conforms to the shape of the upper surface of the rim 124.

The perimeter base of the club head nest 160 matches and nests with the profiles of the middle bag 14 and outer bag 12. The club head nest 160 is attached to the uppermost end of mouth of the middle bag 14. The foam (or rubber) club head nest 160 is secured to the middle bag 14 by compression fit, or by interlocking male/female parts. In the latter embodiment, the foam club head nest 160 is compressed and then pushed into the rim of the golf bag 10. When released, the club head nest 160 expands to its natural state and a female channel 161 running along its outside perimeter is firmly pressed against and engages a male rib 163 running along the inside perimeter of the rim 124 of the middle bag 14.

In one embodiment, the club head nest 160 has a minimum of fifteen molded holes or slots 172. This is because a typical club assortment consists of 14 clubs (3 woods, 10 irons and 1 putter) or (4 woods, 9 irons and 1 putter) along with an umbrella or ball retriever. However, the club head nest can provide more than fifteen holes or fewer than fifteen holes. The club head nest 160 can include a heat pliable membrane which can be custom fit by user to match exact shape of club heads. However, the membrane must not lose its shape in extreme temperatures due to sunlight, etc. The mold for the foam nest can include one or more, inserts to allow for changes in club head configurations.

Alternatively, a riser 159, which can be molded of plastic, is provided for mounting on the rim 124 of the middle bag to stabilize the middle bag during transporting of the golf bag. The riser 159 is positioned between the nest 160 and the top of the middle bag to stabilize it to keep the clubs contained and the middle bag in line. One way of mounting the riser on the middle bag is by compression fit. Alternatively, the riser 159 can have a female channel 167 running along its outside periphery which receives male rib 163 on the rim 124 when the riser 159 is mounted on the middle bag. In either arrangement, the riser 159 fills the space between the top of the middle bag and the bottom of the club head nest 160.

The club divider 162 is formed by two strips 164 of material which have suitable fasteners 166 near their upper edge that couple to the rim 126. The strips 164 of material extend the length of the body portion as is shown in FIG. 21, for example. The full length club fabric dividers 164 eliminate abrasion or snagging of one club against another. Alternatively, the club divider can provide a separate full length divider for each club. The middle bag 14 includes a cover 170, shown in FIG. 21, that can be fitted over the top of the middle bag 14 when the middle bag 14 is used alone, or with the inner bag 16 therein. This cover can include a drawstring, a draw cord, snap fasteners or an elastic base opening to allow the cover to be used on the outer bag 12 to protect clubs as well, when the hard cover 26 (FIG. 1) is not used.

The fabric cover 170 for the top of the middle bag 14, which can be acrylic fur lined or foam padded, for example, is made with a zipper 171 to allow access to clubs during play. This cover attaches to the outside perimeter of the mouth of the middle bag 14 via snaps, elastic, draw string or other fastener structure. It is used to contain and protect clubs during transport, as well as during play in inclement weather. The cover 170 can double as a liner cushion for the heads of the golf club heads when stored in the outer bag 12 of the top cover.

Figure 24:
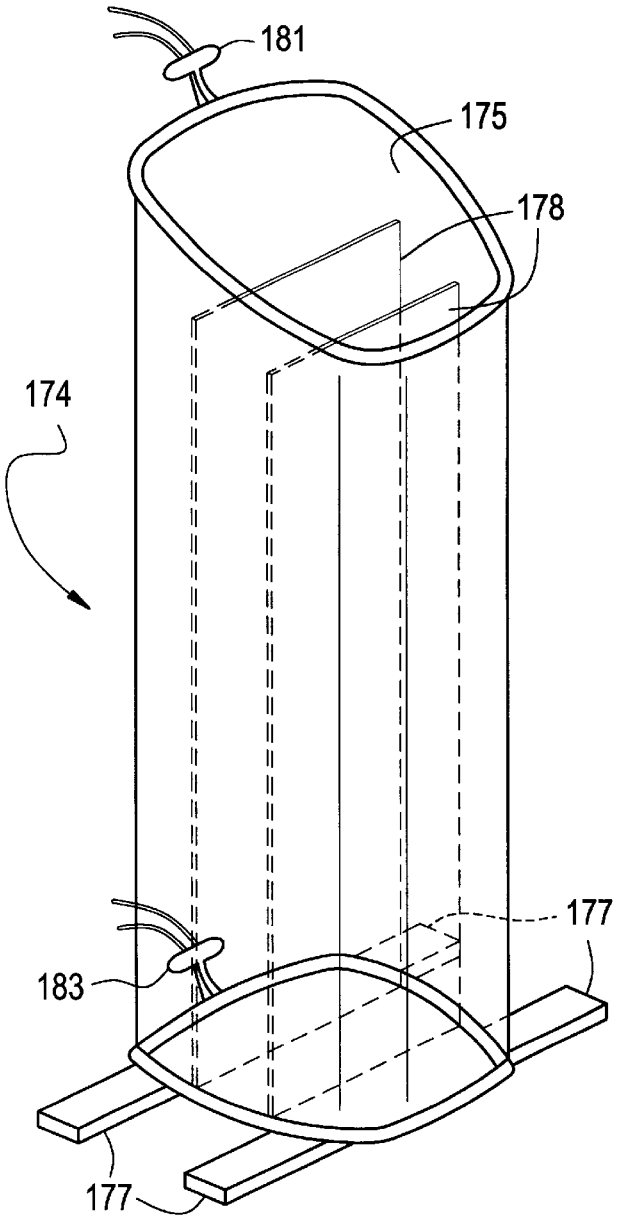
FIG. 24 is an isometric view of a golf club divider for the golf bag assembly of FIG. 1.
Figure 25:
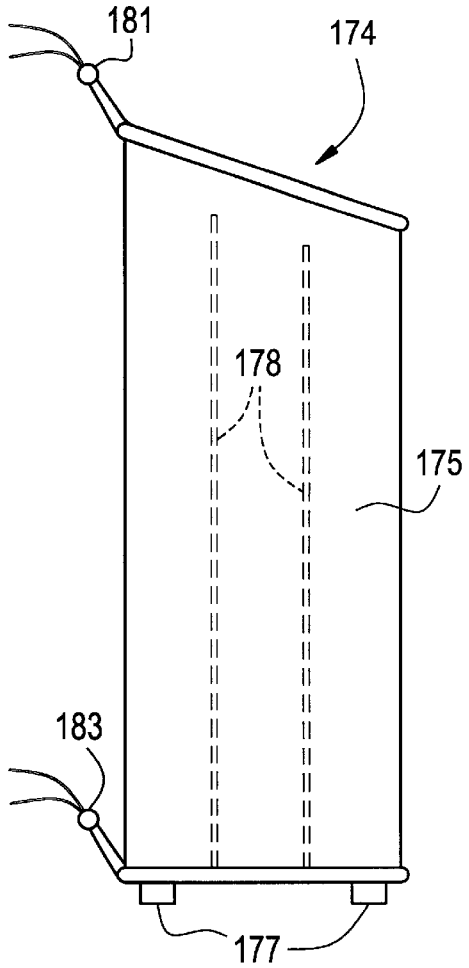
FIG. 25 is a side view of the golf club divider of FIG. 24.
Figure 29:
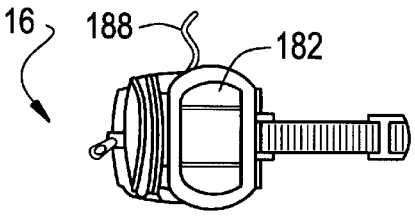
FIG. 29 is a top plan view of the inner bag.

One function of the middle bag 14 is to serve as a club divider for the golf bag 10. When the golf bag 10 is used without the middle bag, a club divider assembly, such as club divider assembly 174 shown in FIGS. 24 and 25, can be used for this purpose. The body 175 of the club divider assembly 174 can be of nylon fabric construction with webbing straps 177 at the lower end for attachment to the outer bag 12 (FIG. 10). The dividers (or a separate full length divider for each club) 178 preferably are full length club dividers, similar to club dividers 164 of the middle bag, and are sewn to the body 175. The webbing straps 177 can include conventional hook and loop type fasteners or snap fasteners for attaching the lower end of the club divider to the inner bag 16. A draw string 181 is provided at the top of the divider assembly 174 for securing the mouth of the club divider to the bottom of the club head nest 160 (FIG. 20). The dividers 178 are located to match the openings 172 through the club head nest. A draw string 183 is provided at the bottom of the divider assembly for drawing the divider body around the clubs contained therein.

Alternatively, the riser 159 (FIG. 20) can be mounted on the middle bag and used, during play, to provide the club dividing function that is provided by the club divider assembly 174 and without the club head nest 160. To this end, the riser 159 has peripherally spaced notches for locating the club heads. The riser 159 cradles and protects the club heads while allowing the shafts of the clubs to be suspended, or to dangle, within the middle bag.

Inner Bag

Referring to FIGS. 26–30, the inner bag 16 is a generally tubular member 180 having an open end 182, the opposite end or head 184 being closed by a zipper 186. The inner bag 16 is made of nylon and the zipper 186 provides access at one end. The open end may be cinched or gathered by a hook and loop type wrap or a draw cord 188, tightening around the exposed clubs, thereby essentially closing the end. A similar draw cord 189 is provided near the closed end. The inner bag 16 can utilize a simple nylon strap approximately 1 to 2 inches in width.

In one embodiment, the inner bag 16 holds five clubs, for example, 1 or 2 woods, 1 or 2 irons and a putter. However, the inner bag 16 can hold fewer or more clubs, depending upon the golfer using the bag. The cinching provided at both ends allows stabilizing of the maximum or a lesser number of clubs during transport. The zippered end, and possibly the outer walls, can be acrylic fur or foam lined to protect the clubs during transport.

As stated previously, the inner bag 16 is designed to nest within the middle bag 14 and function as a portion of the full length club dividers. However, because the inner bag 16 is not formed of a stiff fabric, and the inner bag 16 does not include a skeletal support, the inner bag 16 is held upright by attachment, such as by hook and loop type fasteners 190, to the surrounding "fixed" club dividers or interior walls at the mouth of the middle bag 14. The inner bag 16 can encompass a plurality of full length club dividers.

When set in place within the middle bag 14, the head of the inner bag 16 rests at the bottom or base, while the mouth is closest to the top or mouth 182 of the middle bag 14. The open end rests flush with the other full length dividers just beneath and in line with the holes of the club head nest 160 (FIG. 4). In one embodiment, preparation for use of the inner bag 16 as an ultra-lightweight carry bag requires that it be extracted from within the middle bag 14, and from underneath the club head nest 160. This can involve the removal of some clubs as well as the entire foam nest 160. Alternatively, a two-piece club head nest 160 can be provided which can incorporate a stepped molding of foam material for the club head nest 160, producing compression fit, and/or the use of interlocking male/female undercut parts.

The inner bag 16 can include one or more "half zippers" which allow for the attachment of one or more of the removable or interchangeable fabric storage compartments, such as compartment 142, from the middle bag 14. A carry strap 192 is permanently affixed to the inner bag 16 and lays flat against the side of the inner bag 16 during its insertion, extraction and use within the middle bag 14.

Figure 32:
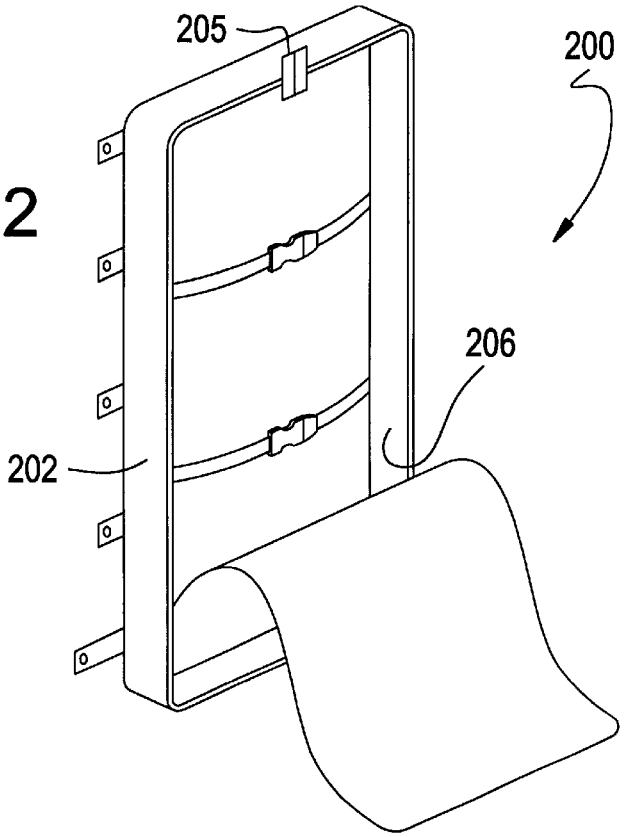
FIG. 32 shows the garment bag of FIG. 31 in its open condition.
Figure 33:
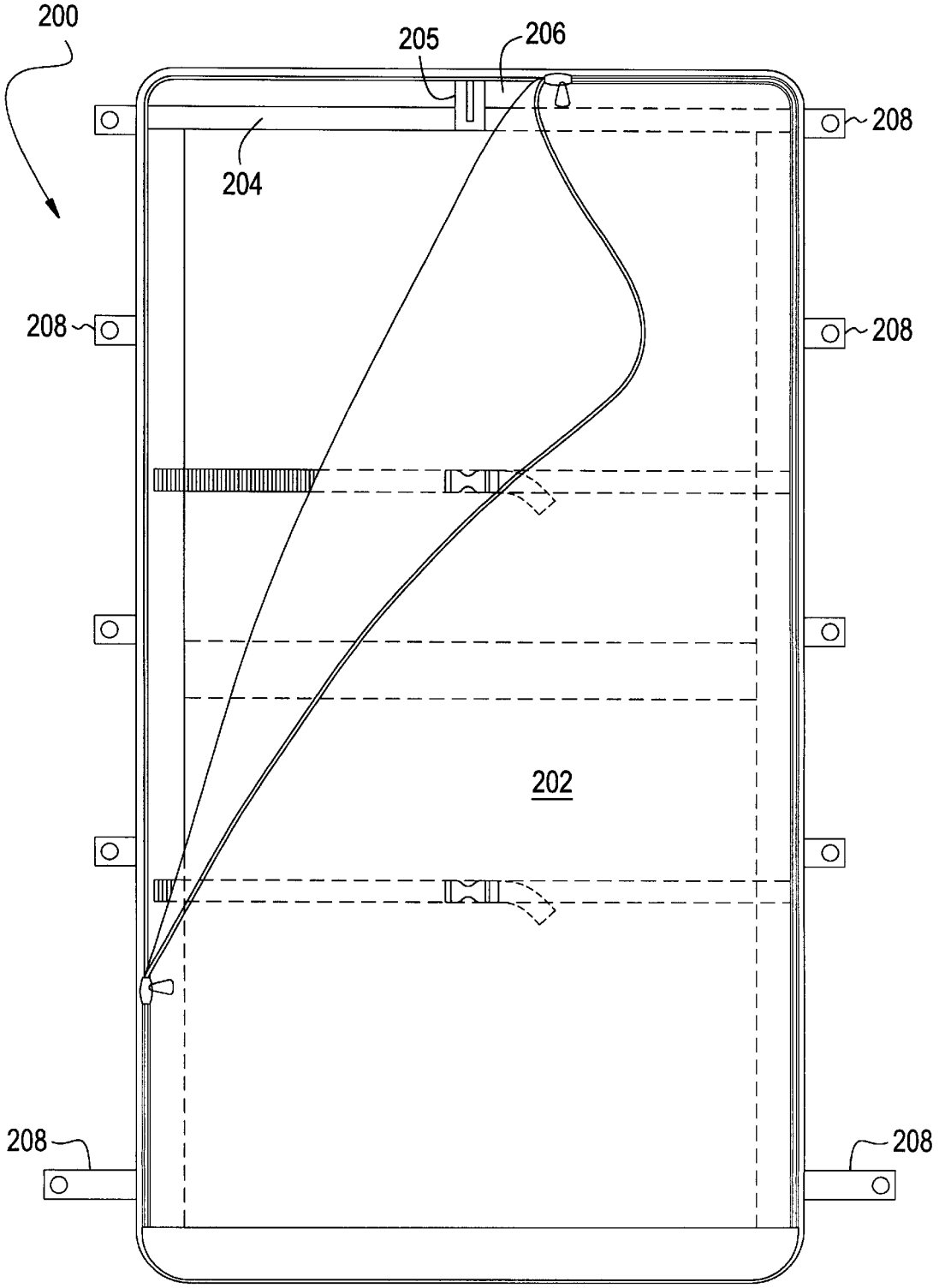
FIG. 33 is a front view of the garment bag shown unfolded.
Figure 34:
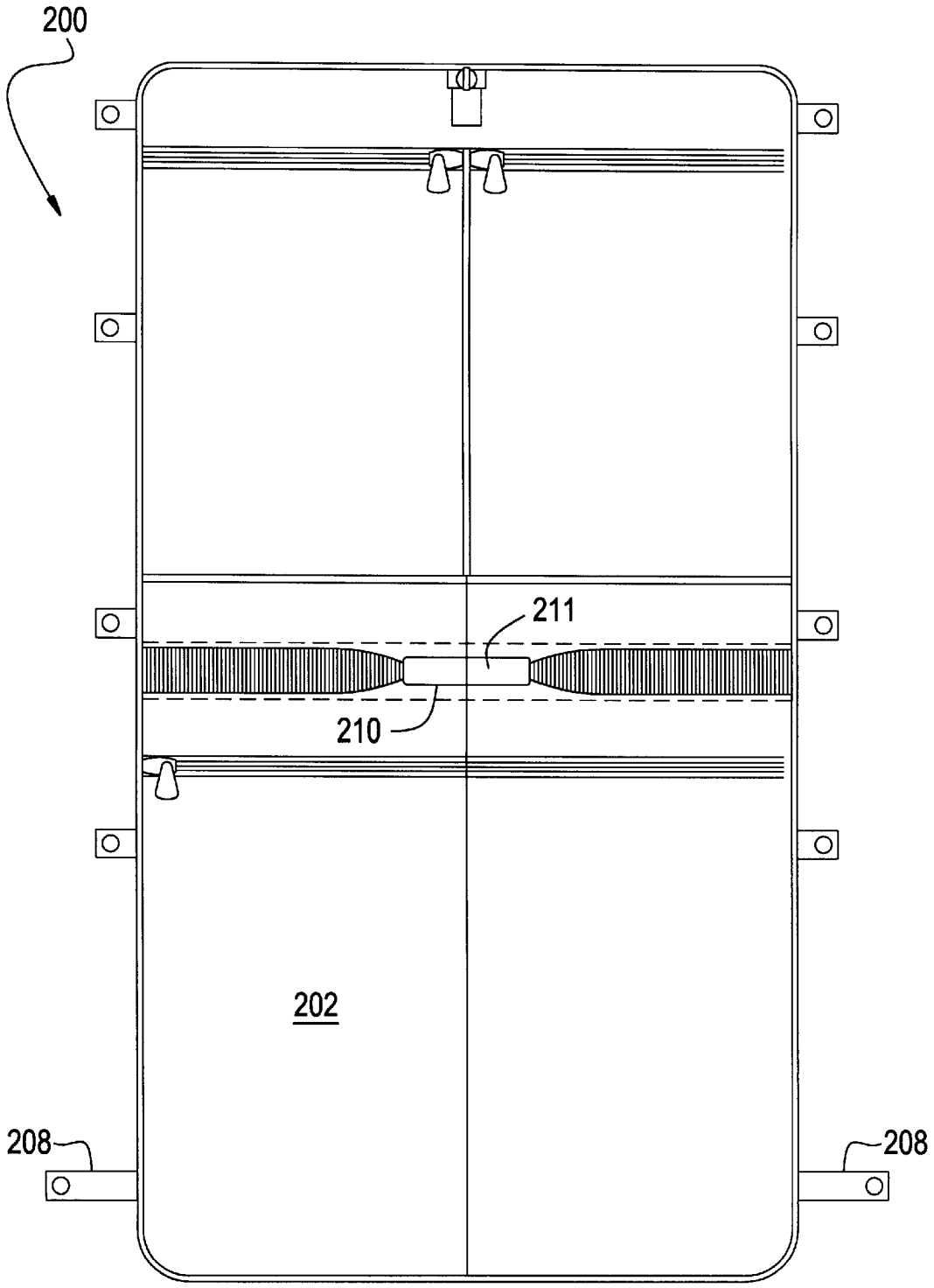
FIG. 34 is a rear view of the garment bag shown unfolded.
Figure 35:
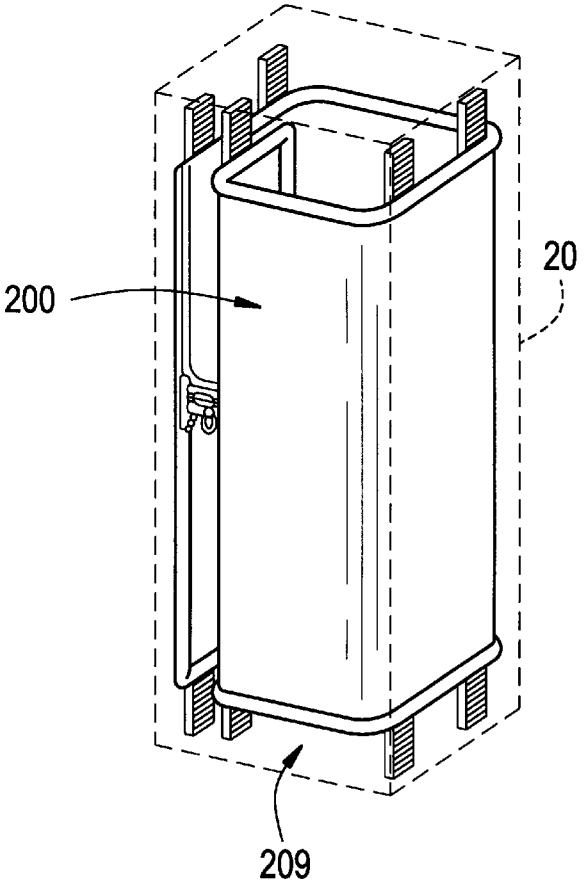
FIG. 35 is an isometric view of the garment bag shown in its folded storage condition.
Figure 36:
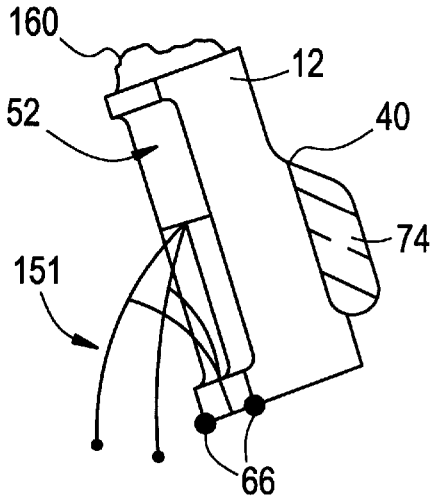
FIG. 36 is a simplified representation of the multi-function golf bag with the front and rear access doors removed.

Referring now to FIGS. 31–35, further in accordance with the invention, the multi-function golf bag includes a garment bag assembly 200 that is adapted for insertion into the multi-function golf bag in addition to or preferably in place of the middle bag 14. The garment bag assembly includes a garment receiving bag 202 having a stiffener 204 (FIG. 33) extending transversely at least at the top and of the garment receiving bag. Further stiffeners can be provided along the length of the sides and at the bottom end. The stiffener 204 has a metal hanger 205, or a fabric loop, affixed thereto by riveting or in any other suitable manner. The garment bag has a zippered opening 206 to allow access to the interior of the garment bag as shown in FIG. 32. The garment bag is adapted to be folded into a generally rectangular configuration as illustrated in FIG. 35. The garment bag includes a plurality of straps 208 carrying snaps or some other suitable fasteners, at the ends thereof for securing the garment bag to an inner surface of the body portion 20 of the outer bag 12 with the garment bag suspended above the bottom 30 of the outer bag body portion 20. As shown in FIG. 35, there is an open space 209 between the lower end of the garment bag and the bottom of the body portion 20, allowing for storage of further articles or pouches and the like and accessible through the front access door 22 or the rear access door 24 (FIG. 10). The space 209, while shown to be generally rectangular, can define a cylindrical opening which can receive the shafts of golf clubs in some applications of the golf bag 10, such as when the middle bag is not used during play. The garment bag includes a carry handle 210 overlying a stiffener 211 near the middle of the garment bag. When the outer bag 12 is used without the middle bag, such as when the garment bag is employed, the club divider assembly 174, shown in FIG. 24, can be used to provide full length protection for golf clubs contained in the golf bag. It is apparent that the garment bag assembly 200, the duffle bag assembly 74 (FIG. 11), the hat support 86 (FIG. 16B) the hanging door organizers and components thereof, as well as the outer bag 12, the middle bag 14 and the inner bag 16, can be used separately and individually of one another in addition to being used an components of the golf bag system 10 as has been described herein as a golf specific organizer of golf accessories and apparel in a neat format. Moreover, any one of these components is functional of itself when removed from the golf bag 10.

Figure 38A:
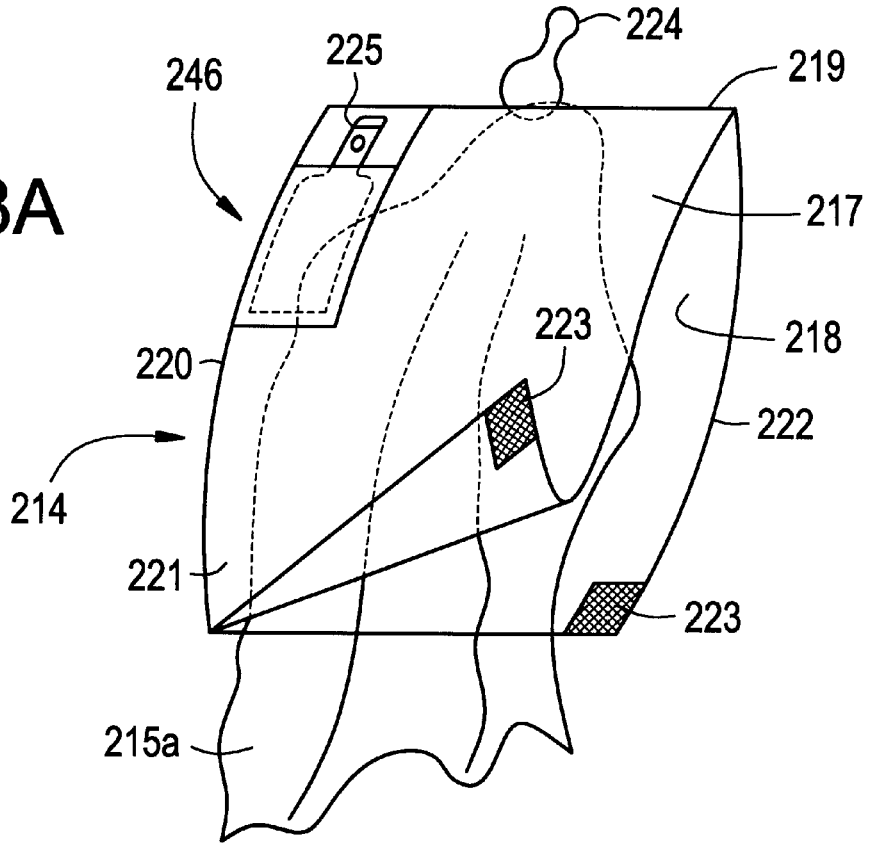
FIG. 38A is a front view of a towel cover and source of water which can be incorporated in the golf bag of FIG. 1.
Figure 38B:
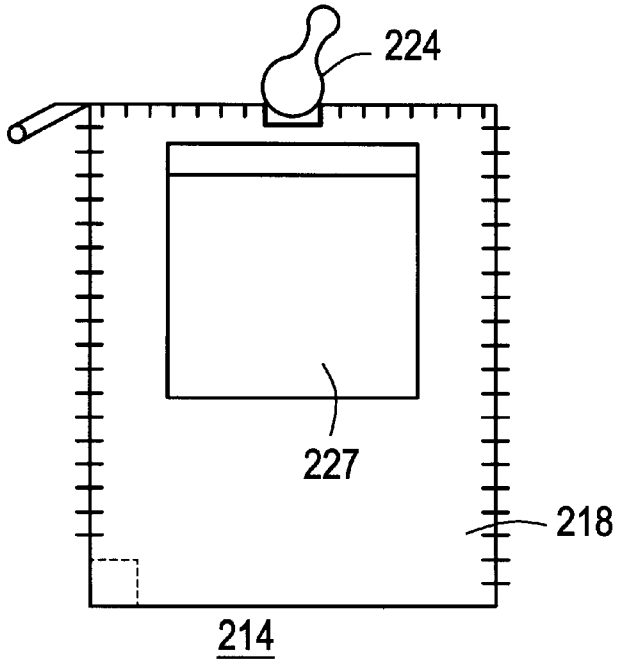
FIG. 38B is a rear view of the towel cover of FIG. 38A.
Figure 39:
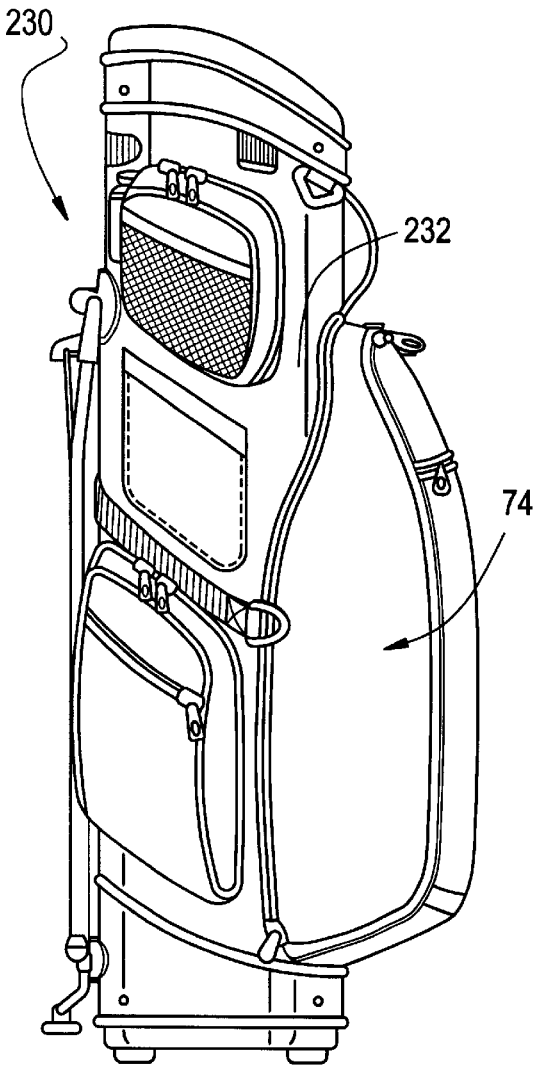
FIG. 39 is a left side view of a further embodiment of middle bag for the multi-function golf bag in accordance with the invention.
Figure 40:
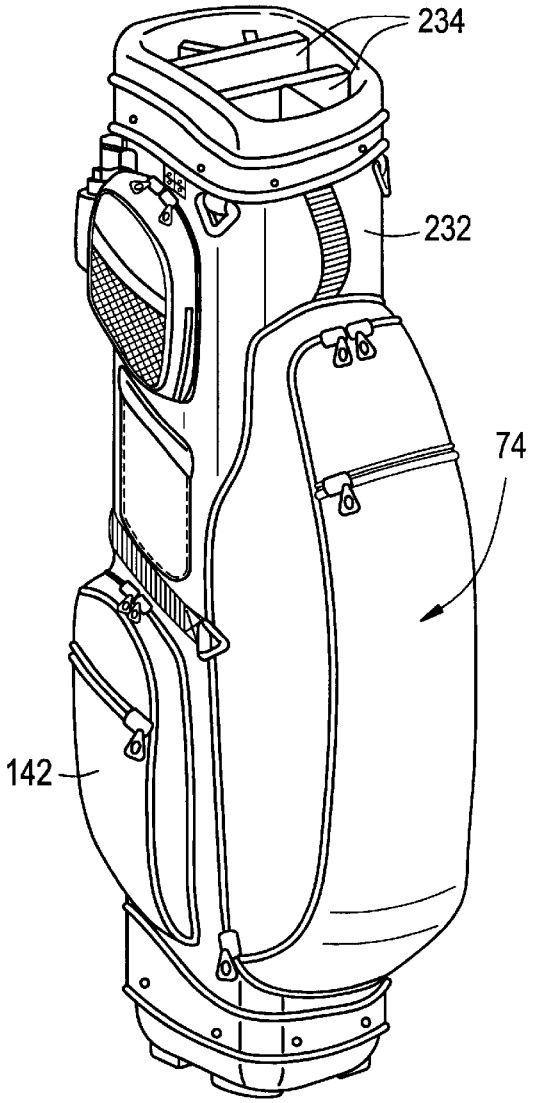
FIG. 40 is a front, left side isometric view of the middle bag of FIG. 38.
Figure 41:
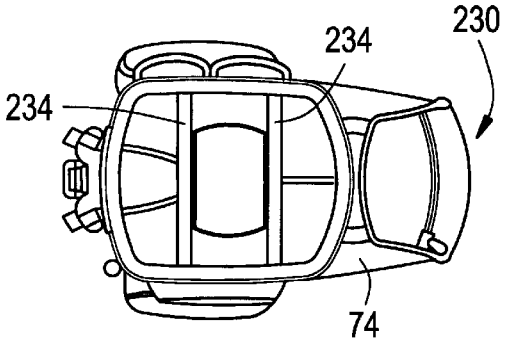
FIG. 41 is a top plan view of the middle bag of FIG. 39.
Figure 42:
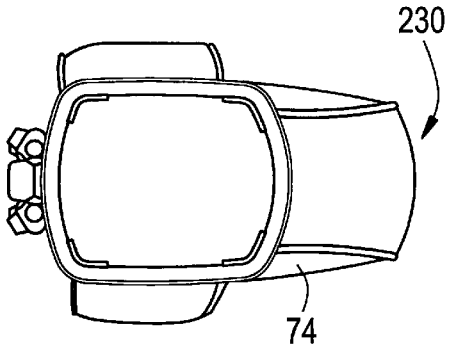
FIG. 42 is a bottom view of the middle bag of FIG. 39.
Figure 43:
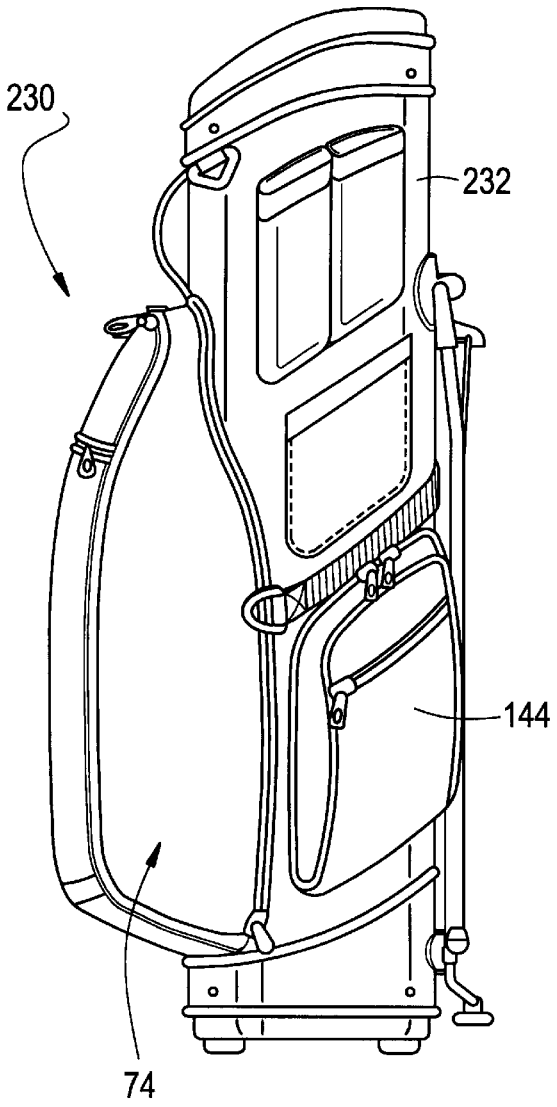
FIG. 43 is a right side view of the middle bag of FIG. 39.
Figure 44:
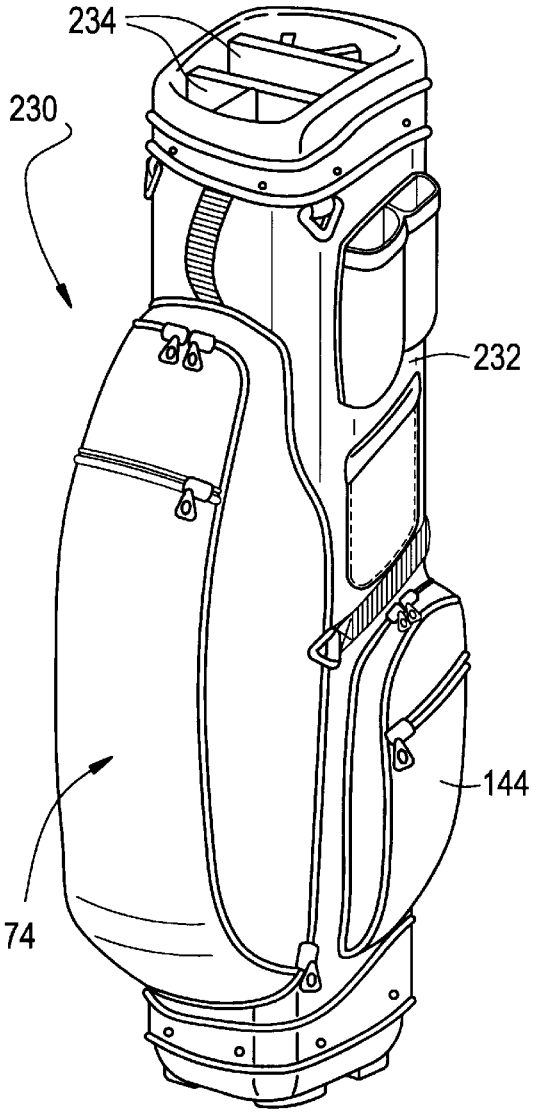
FIG. 44 is a front, right side isometric view of the middle bag of FIG. 39.

Referring to FIGS. 38A and 38B, the golf bag 10 can include a towel cover 214 that protects a towel 215 and provides a source of water 216 for use in the cleaning golf balls, etc. In one embodiment, the cover is formed by two overlying panels 217 and 218 which are sewn together along the top edge 219 and a side edge 220 forming a pouch that is closed along the top edge 219 and on one side 220. The cover 214 is open along the bottom edge 221 and can be closed along the other side 222 such as by conventional hook and loop type fasteners 223.

The towel 215 is located between the panels and is secured via a hook or clasp 224 to a D-ring of golf bag which can extend through a small grommeted opening near the top edge 219. The marginal edge 215A of the towel extends beyond the lower edge of the cover. Thus, the major portion of the towel is contained within the cover, protected from the elements. Access to the towel can be had by separating the panels along the side 222. Because the lower end 215A of the towel projects from the lower end of the cover, in the event of rain, the lower end of the towel can be wetted by the rain.

The source of water 216 can be a small container having a spray nozzle 225 contained within a sewn pocket 226 in panel 217. The nozzle 225 extends above the pocket 226, allowing use without removing the container from the pocket. The cover 214 can be removably attached to the outer bag 12 and/or to middle bag 14 by the connection by the clasp 224 of the towel to D-ring, or can be fixed to either one of the bags. Moreover, the middle bag 14 can have a zipper half to match a zipper half (not shown) on one of the panels for secure mounting. The panel 218 can include a hidden pocket 227 for storing a wallet or other item and the pocket 227 can be closable by conventional hook and loop fasteners, and the like. Also, an affixed, exposed, slightly abrasive sponge-like material (not shown) can be provided for cleaning golf balls.

Use of the Golf Bag

Figure 26:
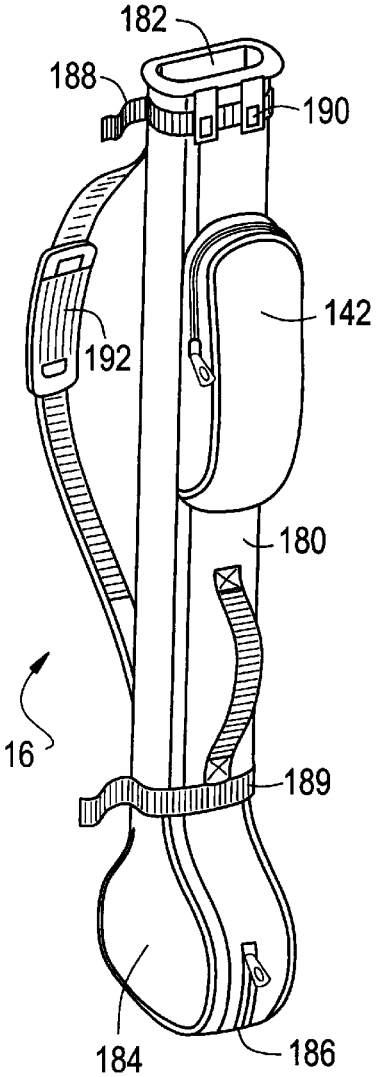
FIG. 26 is an isometric view of the inner bag of the golf bag assembly.

Referring to FIGS. 3, 4 and 26, the following steps will explain the use of the golf bag in a transport mode. First, the inner bag 16 is extracted from the middle bag 14. After reversing the head of the inner bag 16, which was previously positioned at the bottom or base of the middle bag 14, the head of the inner bag 16 is opened by unzipping zipper 186 to expose the lined interior and the full length club divider channel or channels. The clubs are inserted into the inner bag 16 grip ends first. When finished, the head of the inner bag 16 is closed by zipping the zipper 186. The cinch strap 188 at the upper portion 182 of the inner bag 16 can be deployed to stabilize club heads. In addition, the lower portion of the inner bag 16 can be cinched by strap 189 to stabilize the club grips and shafts. A portion of the grips and shafts extend through and beyond the uncinched mouth 182 of the bag, leaving them exposed.

In a play mode, first all cinched areas of the inner bag 16 are relaxed. Then, the head 184 of the inner bag 16 is opened by unzipping the zipper 186, allowing removal of all of the golf clubs contained within the inner bag 16. Then, the zipper 186 is zipped shut to close the head of bag. The clubs are then inserted, grip ends first, into the uncinched mouth 182 of the inner bag 16. The club heads and a portion of their shafts extend through and beyond the uncinched mouth of the inner leaving the clubs exposed for easy insertion and extraction. This function can be facilitated by providing a removable, flexible rod (such as a ¼" diameter rod) which can be inserted into a sleeve/channel near the mouth to dilate the opening 182 and greatly facilitate its use. Attaching (zipping) and inserting and removing items from the interchangeable fabric storage compartment is best done while the inner bag 16 is relaxed (not cinched for stabilization of the clubs).

In an alternative embodiment, the middle bag is not used. The clubs are removed from the three-part golf bag 10 and the middle bag is removed through the rear access door 24 (FIG. 3). In this use of the golf bag (with or without the inner bag 24), the club divider 162 is used. Also, the club head nest 160 is mounted directly on the mouth 60 of the outer bag. Alternatively, if the garment bag assembly 74 is stored in the outer bag 12, the generally cylindrical open center defined by the rolled up garment bag can contain the golf club shafts.

Referring to FIGS. 1, 2, 24 and 36, when using the cylinder-like club divider 162 with the outer bag 12, the front access door 22 and the rear access cover 24, and also the top cover 26, can be removed to reduce weight if the golf bag assembly has to be carried. In addition, a bag stand 151 can be mounted to the rear of the outer bag 12. Moreover, the softside duffle bag 75 is exposed in the opening 40 in the front side of the golf bag assembly, enhancing aesthetics of the golf bag assembly.

Figure 37:
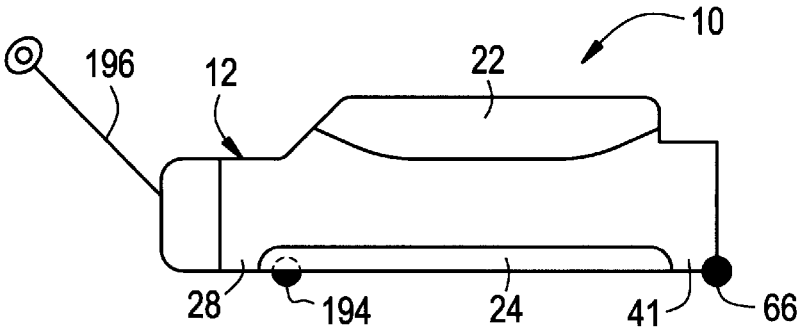
FIG. 37 a simplified representation of the multi-function golf bag incorporating wheels at upper and lower ends of the golf bag, allowing the golf bag to be oriented for transport in a horizontal position.

Referring to FIG. 37, a retractable set of wheels 194 mounted on the golf bag 10 near the upper end 28 of the outer bag 12, supplementing the set of wheels 66 mounted on the lower end 41 of the outer bag 12. Both sets of wheels are mounted on the outer bag 12 in a position that allows the wheels to roll with clearance when the golf bag is oriented in a horizontal position. The retractable wheels 194, when deployed, allow the golf bag 10 to be transported oriented in a generally horizontal position as illustrated in FIG. 37. This allows additional luggage, or packages to be loaded on top of the horizontally oriented golf bag for ease of transport. Moreover, additional luggage can be carried on the outer bag even when the second set of wheels is not used. A fabric pull strap 196 can be attached, if necessary, to the golf bag 10 to facilitate pulling the golf bag 10.

Second Embodiment

Referring now to FIGS. 39–44, there is shown further embodiment for a middle bag 230 for use with the outer bag 10 (FIG. 1) and the inner bag 16 (FIG. 26). The bag 230 includes a soft bag 232 which includes the removable duffle bag 74 assembly that has been described above with reference to FIGS. 11–16. The middle bag 230 can have base removable pockets 142 and 144 similar to those of the inside bag 14 (FIG. 20). The middle bag 230 has a club divider 234 located in the mouth of the bag 232. The golf bag 230 can receive the inner bag 16, which has been described above, such inner bag being positionable in the space between the dividers 234 of the bag 230.

Further Alternative Embodiments

Additional features such as a built-in or snap-in thermometer, digital clock with alarm (solar powered, for example), or a pager or cellular phone compartment can be added to the multi-function golf bag 10 or to the middle bag 14. Although the carting of such items on the golf course does not parallel the game's teachings, it may be a perceived as a highly value added feature to offer such conveniences to our increasingly connected society.

Molded loops or bars (very strong at maximally ⅜" diameter) can replace O-rings and D-rings found on standard golf bags, and can be used for the attachment of miscellaneous accessories (i.e. golf towel, bag tag) via hooks or clasps. Additional locations of this feature may provide points of attachment for the shoulder straps/harness. A ring can be provided securing for a golf towel to the golf case. Also, a grip or handle can be molded or attached to the lower end or base of the outer bag 12 to allow for a balanced two-handed grip when lifting the golf bag.

The outer bag 12 or the middle bag 14 of the golf bag 10 can include a retractable towel on a draw string or elastic band. When in its retracted state, all but a few inches of the towel are exposed to the elements. The towel can be tugged downward, thereby extending the draw string (6 to 10 inches) and exposing the entire towel. To allow resistance-free use of the towel, the end of the string, at its point of attachment to the towel, could be set within a V groove "catch." When finished with towel, a slight tug downward releases the towel and retracts it back up into its original protected position. This application works well in wet weather, especially since clubs and balls clean easier with the wet portion of a towel (exposed end), but can also be completely dried for use with the protected portion of the towel. This feature can comprise a triangular "chute" molded into the outer bag 12 provided on middle bag 14.

The outer bag 12 can also enable attachment of an optional folding seat to the lower position of the case, and an umbrella to the pull cart style handle. Structure can be provided for accommodating either an umbrella or a ball retriever on the exterior of the outer bag 12 or middle bag 14. This feature is used for applications during play and user-responsible transport, but not for public transit.

The golf bag can include a ball compartment. USGA rules state that a compartment for clubs, balls, etc., can be heated prior to play, but no active heat source may be applied or continued during play. Therefore, the golf bag can be adapted to sustain the heat within such a compartment through the use of insulation, or other heat retention elements during play.

The golf bag can include a fabric travel cover for those who wish to keep the outer bag 12 in its best condition, or wish to reduce the possibility of any part of the unit being snagged during transport. The cover allows for access to grips or handles and to the wheels.

Effective tracking via serial and/or production run numbering system, can be built into the mold (i.e. in mold graphics, inserts, etc.), thus instigating user warranty registration cards to establish a database.

The outer bag 12 can be used as an alternative to standard travel luggage, depending upon the internal configuration of the storage compartments. The multi-function golf bag can include features such as lockable, durable, two rolling modes, two pull-handle options, multiple organizer compartments, multiple access points, piggyback luggage feature, and substantial protection for breakables.

Not to condone smoking, however, for user convenience and to help minimize litter on the course, the golf bag can incorporate a built-in cigar/cigarette holder (i.e. press fit, tension clip). Such holder can be removable and act as a stand/spike into the ground for raising the smoke stick up and away from turf pesticides.

What is claimed is:

1. A multi-function golf bag comprising:

an outer bag of a rigid material, the outer bag including an elongated body portion having a closed lower end, an open upper end, and at least first and second sides with an access opening through at least one of the sides;

at least one inner bag of a soft material, said one inner bag being adapted to nest within the outer bag with said one inner bag functioning as a containment system for golf clubs and accessories, the access opening being dimensioned to allow said one inner bag to be removed from the outer bag through the access opening for use as a functional golf bag; and a lid of a rigid material mounted on the upper end of the outer bag for closing the upper end to enable the outer bag to function as a protective and decorative enclosure for said one inner bag, the lid being removably mounted on the upper end for enabling the lid to be removed from the body portion to provide access to said one inner bag through the open upper end, allowing the outer bag to be used as a functional golf bag, wherein said one inner bag includes a plurality of dividers which extend substantially the full length of the sides of the outer bag, and the inner bag being removable from the outer bag for use as a functional golf bag having substantially full length club dividers.

2. The multi-function golf bag according to claim 1, wherein said one inner bag includes at least one storage compartment on an outer surface thereof, and wherein the outer bag includes a further access opening through the other one of the sides, the further access opening being dimensioned to allow access through the further access opening to the storage compartment on said one inner bag.

3. The multi-function golf bag according to claim 2, and including a second access cover for closing the further access opening.

4. The multi-function golf bag according to claim 1, and including a further inner bag of a soft material including said plurality of dividers for containing a plurality of golf clubs, the further inner bag being adapted to nest within said one inner bag, said one inner bag and the further inner bag being removable as a unit from the outer bag through the access opening for use as a functional golf bag.

5. A multi-function golf bag comprising:

an outer bag of a rigid material, the outer bag including an elongated body portion having a closed lower end, an open upper end, and at least first and second sides, at least one of the sides having an access opening therethrough to provide access to the interior of the outer bag;

a club divider located within the interior of the outer bag, the club divider including a plurality of dividers which extend substantially the full length of the sides of the outer bag, and the club divider being removable from the outer bag for use as a functional golf bag having substantially full length club dividers; and a lid of a rigid material mounted on the upper end of the outer bag for closing the upper end to enable the outer bag to function as a protective and decorative enclosure for the club divider, the lid being removably mounted on the upper end for enabling the lid to be removed from the body portion to provide access to the club divider through the open upper end, allowing the outer bag to be used as a functional golf bag, wherein the access opening is dimensioned to allow the club divider to be removed from the outer bag through the access opening.

6. The multi-function golf bag according to claim 5, and including a second inner bag of a soft material for containing a plurality of golf clubs, the second inner bag being adapted to nest within the first inner bag, the first and second inner bag being removable as a unit from the outer bag, through said access opening for use as a functional golf bag.

7. A multi-function golf bag comprising:

an outer bag of a rigid material, the outer bag including an elongated body portion having a closed lower end, an open upper end, and at least first and second sides with a first access opening through the first side and a second access opening through the second side;

a first access cover mounted on the first side for closing the first access opening, the first access cover being movable to an access position to allow access to the interior of the outer bag through the first access opening;

a second access cover mounted on the second side for closing the second access opening, the second access cover being movable to an access position to allow access to the interior of the outer bag through the second access opening;

a middle bag of a soft material, the middle bag functioning as a containment system for golf clubs and accessories, and the middle bag including at least one storage compartment, the first access opening being dimensioned to allow the storage compartment to be accessed through the first access opening when the first cover is in its access position;

an inner bag of a soft material for containing a plurality of golf clubs;

the middle bag being adapted to nest within the outer bag, and the inner bag being adapted to nest within the middle bag, the middle bag and the inner bag being removable as a unit from the outer bag for use as a functional golf bag; and a lid of a rigid material mounted on the upper end of the outer bag for closing the upper end to enable the outer bag to function as a protective and decorative enclosure for said one inner bag, the lid being removably mounted on the upper end for enabling the lid to be removed from the body portion to provide access to said one inner bag through the open upper end, allowing the outer bag to be used as a functional golf bag.

8. The multi-function golf bag according to claim 7, wherein the inner bag is removable from the middle bag.

9. The multi-function golf bag according to claim 7, wherein the second access opening is dimensioned to allow middle bag and the inner bag are removable as a unit from the outer bag through the second access opening when the second access cover is in its access position.

* * * * *